US007314267B2

(12) United States Patent
Yamaguchi et al.

(10) Patent No.: US 7,314,267 B2
(45) Date of Patent: Jan. 1, 2008

(54) INK JET PRINTING APPARATUS

(75) Inventors: Nobuhito Yamaguchi, Tokyo (JP); Koichiro Nakazawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 388 days.

(21) Appl. No.: 11/073,732

(22) Filed: Mar. 8, 2005

(65) Prior Publication Data

US 2005/0200649 A1 Sep. 15, 2005

(30) Foreign Application Priority Data

Mar. 11, 2004 (JP) ..... 2004-069170

(51) Int. Cl.
*B41J 2/135* (2006.01)

(52) U.S. Cl. ..... 347/45; 347/96

(58) Field of Classification Search ..... 347/95, 347/28, 33, 43, 45, 96
See application file for complete search history.

(56) References Cited

U.S. PATENT DOCUMENTS

| | | | | |
|---|---|---|---|---|
| 5,381,169 | A * | 1/1995 | Arai et al. | 347/33 |
| 5,969,731 | A * | 10/1999 | Michael et al. | 347/33 |
| 6,378,981 | B1 * | 4/2002 | Wenzel et al. | 347/28 |
| 6,467,873 | B1 * | 10/2002 | Toba et al. | 347/33 |

FOREIGN PATENT DOCUMENTS

| | | |
|---|---|---|
| JP | 57-125059 | 8/1982 |
| JP | 57-133074 | 8/1982 |
| JP | 62-25055 | 2/1987 |
| JP | 4-115954 | 4/1992 |
| JP | 10-151759 | 6/1998 |

OTHER PUBLICATIONS

English Translation of Japanese Laid-Open Patent Application No. 10-151759.

* cited by examiner

*Primary Examiner*—Thinh Nguyen
(74) *Attorney, Agent, or Firm*—Fitzpatrick, Cella, Harper & Scinto

(57) ABSTRACT

An ink jet printing apparatus can prevent or suppress the generation, by a reaction liquid and ink, of a reaction product on the face surface of a discharge head, and can remove the ink, the reaction liquid or the reaction product adhering to the face surface so as to constantly maintain a stable printing quality. Immediately before a printing operation is initiated, an anti-coagulation liquid is sprayed on the face surface of a discharge head, and the discharge head performs the discharge operation (printing operation) with the anti-coagulation liquid applied to the face surface. When the printing operation has been completed, or when the printing of a predetermined amount of data has been performed, the face surface of the discharge head is wiped by blades to remove the ink and the reaction liquid. Since the anti-coagulation liquid is applied to the face surface in advance, the generation of the reaction product on the face surface is prevented or suppressed. Furthermore, even when a reaction product is adhered to the face surface, the coagulation of this product on the face surface can be prevented.

10 Claims, 15 Drawing Sheets

ENLARGED TOP VIEW OF FIG. 16B

INK JET PRINTING APPARATUS

BACKGROUND OF THE INVENTION

1. Field of the Invention

The present invention relates to an ink jet printing apparatus, and, in particular, to an ink jet printing apparatus that performs printing by discharging, onto a recording medium, an ink and a liquid composition that renders a coloring material in the ink insoluble or flocculated.

2. Description of the Related Art

Conventionally, it is well-known that, for an ink jet printing apparatus, a liquid compound (hereinafter also referred to as a "reaction liquid") that reacts with ink, rendering the coloring material in the ink insoluble or flocculated, is employed in order, for example, to improve water repellency, durability and the development of color on a printed image.

Sometimes, however, with such an ink jet printing apparatus, tiny floating droplets, constituent components of a mist generated when ink and a reaction liquid are discharged from an ink jet head, are attached to and coagulate on a surface in the vicinity of discharge ports formed in a face (hereinafter also referred to as a face surface) of the ink jet head. Further, the ink and the reaction liquid, or a mixture thereof, may splash back from the surface of a print medium, and the constituent components of a product, generated by the reaction of the ink with the reaction liquid, may attach themselves to and coagulate on the face surface. The reaction product thus coagulated near a discharge port could directly cause the clogging of the ink discharge port and a deviation (hereinafter also referred to as deflection) in the ink discharge direction. Furthermore, ink could be attached around the reaction product on the face surface, until it reaches the discharge port, so that a discharge failure or the deflection of the discharge direction could occur. Due to a discharge failure, for example, the deterioration of printing quality could occur. Furthermore, the above described problems could also be caused by ink and reaction liquid that leak from a discharge port.

In order to prevent the clogging of an ink discharge port due to the evaporation of an ink solvent and the deterioration of printing quality due to deflection, and also to recover to an appropriate discharge condition, a conventional ink jet printing apparatus performs various recovery operations, such as capping, suction, cleaning and wiping, using a rubber blade (hereinafter also referred to simply as wiping), and rubbing of a face surface (hereinafter also referred to simply as rubbing) using a rubbing member that employs an absorption material or a porous material.

For example, one conventional ink jet printing apparatus performs a recovery process using a cleaning liquid (see Japanese Patent Laid-Open Publication Nos. Sho 57-125059, Sho 57-133074 and Sho 62-25055). However, this method is not effective for a coagulated product generated by the reaction of ink with a reaction liquid.

Furthermore, a cleaning agent containing, at the least, an organic solvent, a surfactant and water is also well-known (see Japanese Patent Laid-Open Publication No. Hei 4-115954). However, this method is not considered adequate for the removal of a reaction product coagulated on a face surface.

Another means has been proposed whereby, after a discharge operation to be performed for a predetermined period has been completed, a liquid solvent is applied to the face surface of an ink jet head to dissolve a coagulated product thereon, and once the product has been dissolved, it is removed by wiping (see Japanese Patent Laid-Open Publication No. Hei 10-151759). However, since once the product has coagulated on the face surface it can not easily be dissolved, even after the liquid solvent has been applied and the wiping has been performed, traces of the product remain.

Recently, the trend is to form dots having reduced diameters in order to improve the quality of images, and thus, only small amounts of ink, i.e., small ink droplets, are discharged from ink discharge ports. Since the ink droplets are so small in size, they tend to form a floating mist and to be attached to the face surface. Accordingly, a coagulated product tends to be generated.

For an ink jet printing apparatus employing ink and a reaction liquid, generally, separate caps and blades, used for a suction recovery process and for wiping, are prepared for ink use and for reaction liquid use. This is because when only one cap is employed to perform, at the same time, suction for a discharge face from which a reaction liquid is discharged and for a discharge face from which ink is discharged, the reaction liquid and the ink would react with each other in the cap, and the product generated by the reaction would be attached to the face surface. Likewise, were only one blade to be employed for wiping both the reaction liquid discharge face and the ink discharge face, the reaction liquid and the ink attached to the blade would react with each other, and a reaction product would be generated. Therefore, to avoid the generation of a reaction product, separate caps and blades are prepared for reaction liquid use and for ink use, and recovery operations for a reaction liquid head and an ink head are performed separately, not at the same time. In many cases, the recovery process is performed for ink first, and then, the recovery process is performed for the reaction liquid.

As is described above, for an ink jet printing apparatus employing a reaction liquid and ink, since the coagulated reaction product on the face surface is comparatively strong, the product cannot be fully removed by applying the liquid solution, and traces will remain on the face surface. As a result, attaining a satisfactory discharge is difficult. Especially after wiping has been completed, the reaction product may be spread out and remain as a stain on the face surface, and removing such a stain is more difficult.

In addition, after a liquid solution has been applied to the face surface, a certain period of time must elapse before the dissolution of the reaction product is sufficient to permit it to be easily removed from the face surface. Further, once the reaction product has been generated, even though it can be easily removed by applying the liquid solution, a wiping operation for scraping off the reaction product is still required. Therefore, compared with the case wherein ink attached to the face surface is removed simply by wiping, the number of times wiping is performed is increased. As is described above, a certain period of time is required to remove the generated reaction product on the face surface. When this processing is performed repeatedly, each time the printing of a predetermined amount of data is performed, the period required for the processing of all the print data is extended, and this is a problem that is exacerbated by the printing speed.

Furthermore, since an operation for scraping off the thus generated reaction product is performed using a comparatively hard blade and a force that exceeds that required for removing ink, scratching of the face surface tends to occur. And damage to the face surface is a factor that tends to reduce the durability of an ink jet head.

Further, for an ink jet printing apparatus employing a reaction liquid and ink, since removal of a reaction product that cannot be removed simply by wiping is also attempted during the other recovery processing, there is a trend for the period required for each recovery process to be extended, so it is longer than that for an ink jet printing apparatus that employs only ink. Especially, the number of times the suction recovery operation is performed is increased, and exceeds that required for an apparatus that employs only ink, i.e., the amount of ink consumed at times other than during printing is increased, which is very uneconomical.

SUMMARY OF THE INVENTION

To resolve the above described problems, the present invention provides an ink jet printing apparatus that prevents or suppresses the generation of a reaction product by a reaction liquid (a liquid composition) and ink on a face surface, and that removes the ink, the reaction liquid and the reaction product attached to the face surface, so that a stable printing quality can be maintained.

The present invention also provides an ink jet printing apparatus that can prevent ink and a reaction liquid from generating a reaction product that will coagulate near discharge ports, and that can reduce any deviation in the direction of an ink discharge.

According to the present invention, an ink jet printing apparatus, which employs an ink discharge port for the discharge of ink, and a reaction liquid discharge port for the discharge of a reaction liquid that renders ink insoluble or flocculated and that discharges the ink and the reaction liquid onto a printing medium for performing printing, comprises: an application unit for, before ink is discharged from the ink discharge port and/or reaction liquid is discharged from the reaction liquid discharge port, applying to a discharge face, wherein the ink discharge port and/or the reaction liquid discharge port is arranged, a predetermined liquid that prevents or suppresses the generation of an insoluble product or a flocculated product due to the reaction of the ink with the reaction liquid.

Also, according to the invention, an ink jet printing apparatus, which employs an ink discharge port for the discharge of ink and a reaction liquid discharge port for the discharge of a reaction liquid that reacts with the ink, and which discharges the ink and the reaction liquid onto a printing medium for printing, comprises: an application unit for, before a printing operation is started, applying, to a discharge face where the ink discharge port is arranged and a discharge face where the reaction liquid discharge port is arranged, a predetermined liquid that prevents or suppresses the generation of a reaction product by the reaction of the ink with the reaction liquid; a printing controller for performing the printing operation while the predetermined liquid is applied to the discharge faces; and a wiping unit for wiping the discharge faces following the completion of a printing operation, for processing a predetermined amount of data, or following the elapse of a predetermined period of time during which the application unit brings a holding member, which holds the predetermined liquid, into contact with the discharge faces, and applies the predetermined liquid to the discharge faces.

With this arrangement, since the printing operation is performed by using a discharge head to which the liquid (an anti-coagulation liquid) is applied in advance to prevent or suppress the generation of a reaction product by a reaction of the ink with the reaction liquid, the generation of a reaction product and the attachment of the reaction product to the face surface can be prevented or suppressed, even when, during the discharge of ink, a floating mist comprising the reaction liquid and the ink is produced and is attached to the discharge face (face surface) of the discharge head. Further, even when the reaction product is generated on or attached to the face surface, the reaction product cannot easily coagulate. Therefore, there is little contamination of the discharge faces, and a reaction product attached to the discharge ports can be easily removed.

Further features and advantages of the present invention will become apparent from the following description of exemplary embodiments (with reference to the attached drawings).

DESCRIPTION OF THE EMBODIMENTS

The embodiments of the present invention will now be described in detail while referring to the accompanying drawings.

Figure 1:
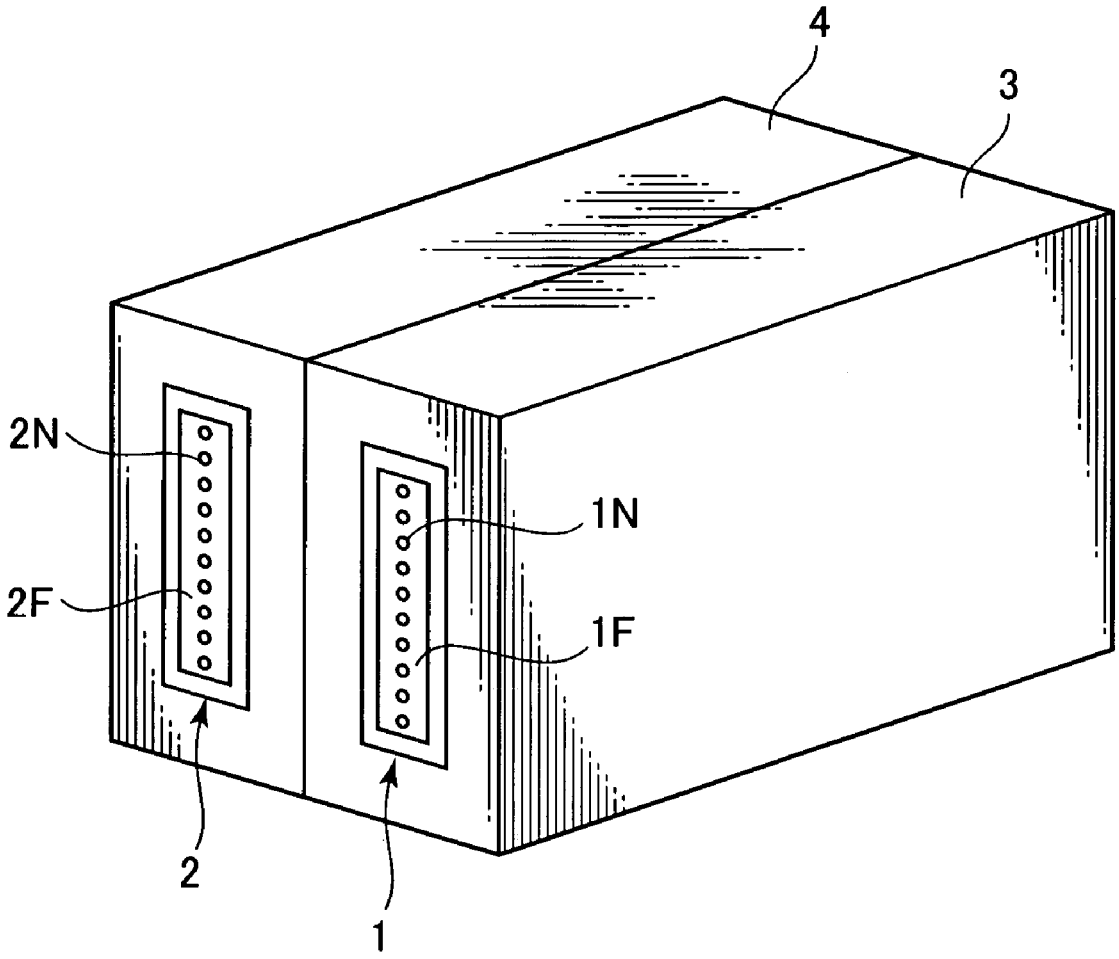
FIG. 1 is a perspective view of the external appearance of a discharge unit according to the present invention.

FIG. 1 is a specific perspective view of a liquid discharge unit according to the present invention.

The liquid discharge unit in FIG. 1 is an assembly for a reaction liquid discharge unit, which discharges a reaction liquid to render ink insoluble or flocculated, and an ink discharge unit, which discharges ink. The reaction liquid discharge unit includes a reaction liquid head 2, for discharging a reaction liquid, and a reaction liquid tank 4, in which the reaction liquid to be supplied to the head 2 is retained. Similarly, the ink discharge unit includes an ink head 1, for discharging ink, and an ink tank 3, in which ink to be supplied to the head 1 is retained. The reaction liquid head 2 has, on reaction liquid discharge port face 2F, 256 discharge ports 2N, through each of which 5 pl of reaction liquid is discharged per each discharge. The ink head 1 has, on ink discharge port face 1F, 256 discharge ports 1N, through each of which 4 pl of ink is discharged per each discharge.

Figure 2:
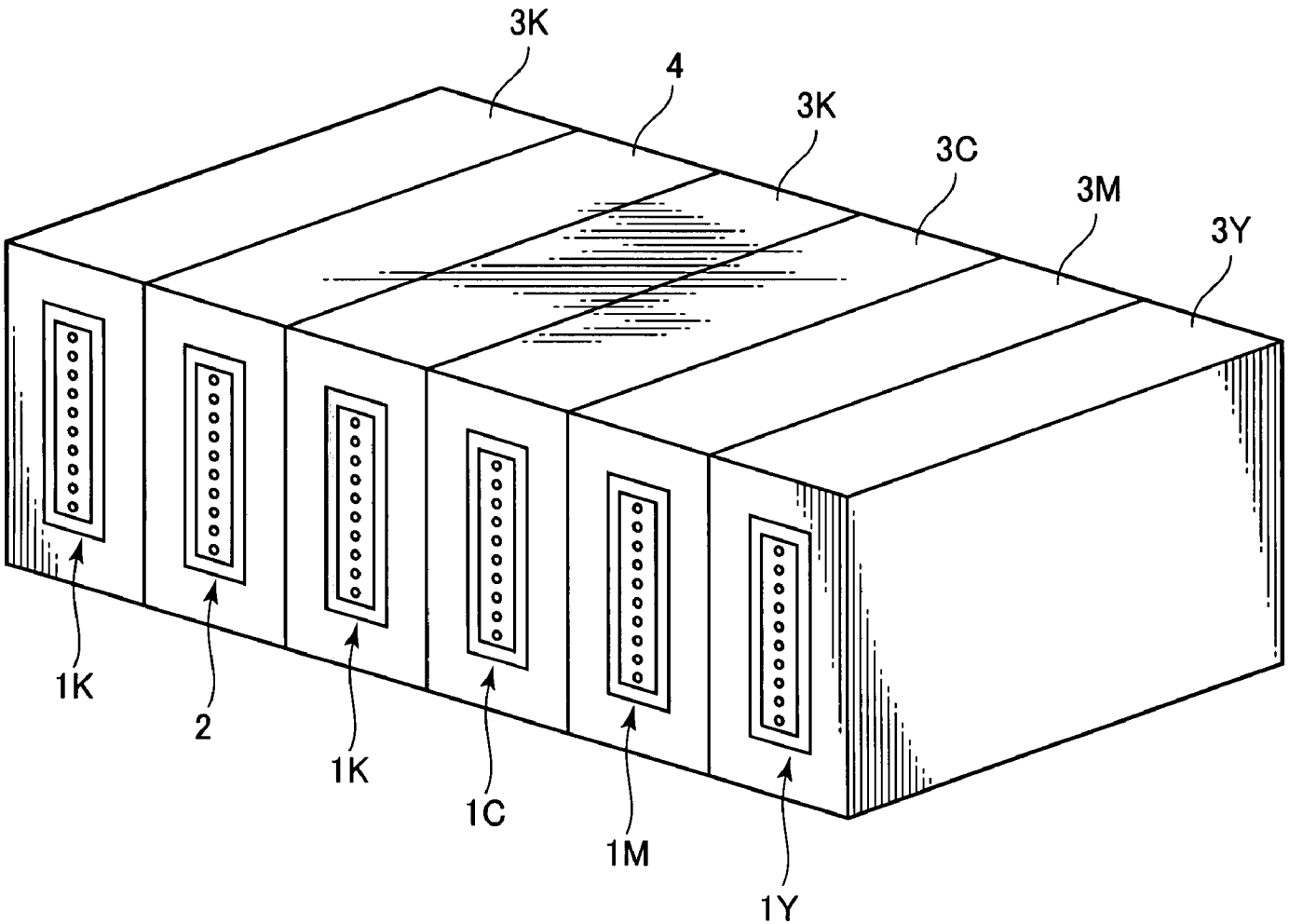
FIG. 2 is a perspective view of the external appearance of another example discharge unit.

The structure of the discharge unit of the invention is not limited to the example shown in FIG. 1, but it is important that both ink and a reaction liquid be employed. Another example discharge unit is shown in FIG. 2. The discharge unit shown in FIG. 2 is compatible with full color printing, and has two black ink heads 1K and cyan, magenta and yellow heads 1C, 1M and 1Y, and a reaction liquid head 2 that is located between the two black ink heads 1K. However, the ink head and the reaction liquid head need not be provided as a single unit; they may be provided as separate units. And the ink discharge ports and the reaction liquid discharge ports need not always be arranged in different heads; they may be provided in the same face surface of a single head.

The ink and the reaction liquid applicable for this invention are not especially limited, and well-known conventional materials can be employed.

Pigment ink, for which a pigment is provided as a coloring agent, dye ink, for which a dye is provided as a coloring agent, or an ink mixture, for which a pigment and a dye are provide as coloring agents, can be employed as the ink for the invention.

Further, any reaction liquid can be employed, so long as it reacts with ink.

When dye ink is employed, a reaction liquid containing an element that renders dye insoluble can be employed. For an anionic dye, a reaction liquid containing a cationic element that renders the dye insoluble can be employed.

When pigment ink is employed, a reaction liquid that contains an element for flocculating the pigment can be employed. An element that flocculates the dye is, for example, a polyvalent metal salt that consists of divalent or polyvalent metal ions and anions coupled with the polyvalent metal ions. Specific example polyvalent metal ions are divalent metal ions, such as $Ca^{2+}$, $Cu^{2+}$, $Ni^{2+}$, $Mg^{2+}$ or $Zn^{2+}$, and trivalent metal ions, such as $Fe^{3+}$ or $Al^{3+}$, and example anions are $Cl^-$, $NO_3^-$ or $SO_4^-$.

Figure 3:
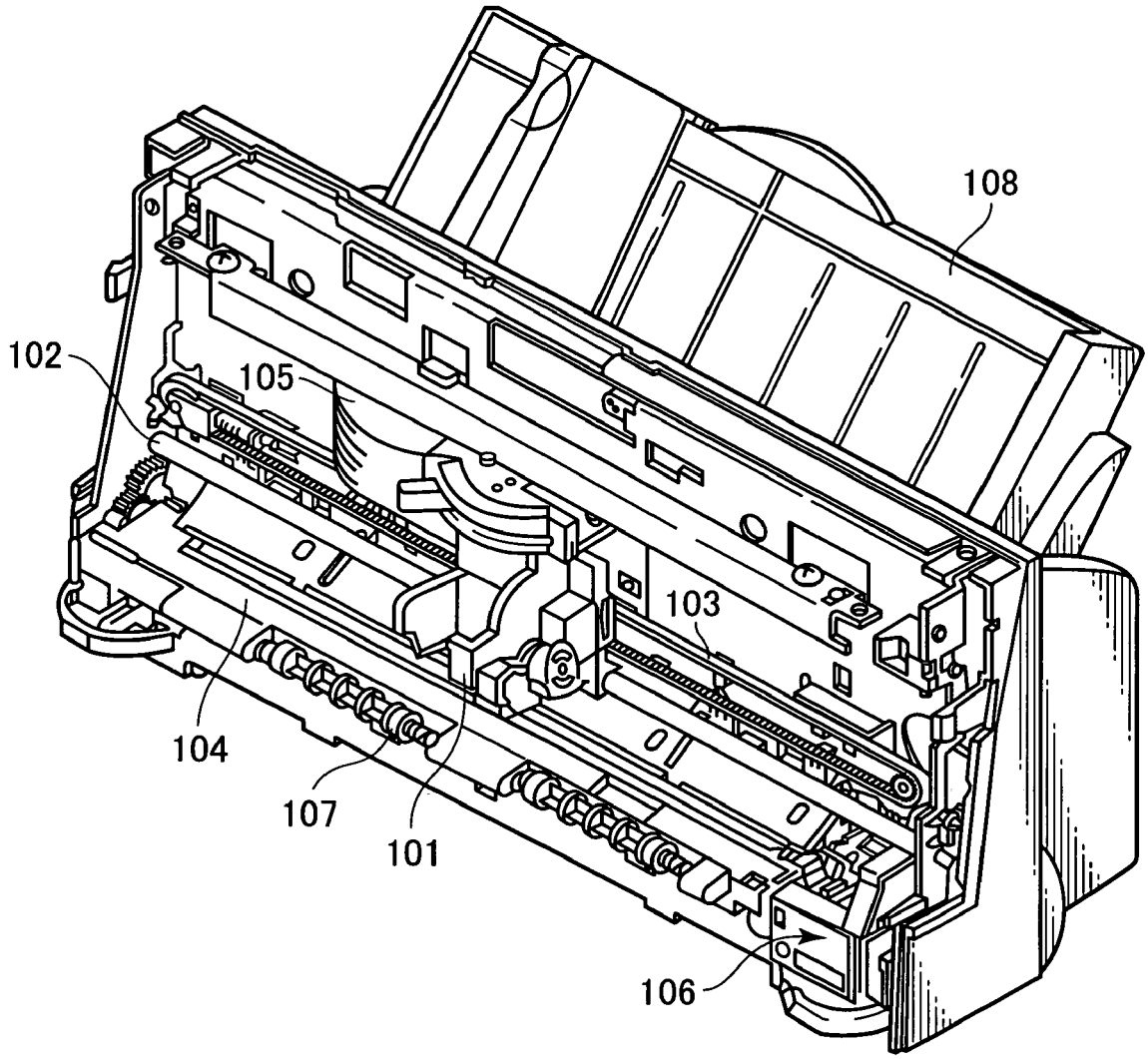
FIG. 3 is an overall perspective view of an ink jet printing apparatus according to the invention.

FIG. 3 is a diagram showing an ink jet printing apparatus that can employ the above-described discharge unit. The ink jet printing apparatus in FIG. 3 mainly comprises: a sheet supply unit, a sheet feeding unit, a carriage unit and a cleaning unit.

In the carriage unit, a carriage 101 is detachably mounted, on the above discharge unit, so that it is movable. That is, in the carriage unit, a guide shaft 102 engages the carriage 101, so that the carriage 101 can slide along the guide shaft 102, and a belt 103 is extended alongside the guide shaft 102. With this structure, the carriage 101 can be moved by a driving force, produced by a motor (not shown), that is transmitted along the belt 103. Provided for the carriage 101 is an electric connector for connecting the individual heads mounted on the carriage 101 and the main body of the ink jet printing apparatus, and a flexible cable 105 across which electrical signals are exchanged by the carriage 101 and the main body.

A cleaning unit 106, located at one end of the range within which the carriage 101 is moved, includes a wiping blade and an anti-coagulation liquid sprayer, which are used for a discharge/recovery process that will be described later, a conventionally known cap, and a pump that performs a suction recovery process through the cap (these components are not shown in FIG. 3).

Sheets (not shown) used as printing media are stacked on a supply tray 108 of the printing apparatus, and once the printing operation has begun, are individually supplied within the range scanned by the carriage 101. While the recording surface of each sheet is held flat by a platen 104 at a location opposite the discharge port face (face surface) of each of the heads that are mounted on the carriage 101, the sheet is intermittently conveyed by convey rollers (not shown). During this conveying process, printing of the sheet is performed by the discharge of ink and a liquid composition by the individual heads. The thus printed sheets are sequentially discharged, externally, by discharge rollers 107, in synchronization with the intermittent sheet conveying procedure.

According to the apparatus of this embodiment, reaction liquid is discharged by the reaction liquid head 2, and ink is discharged thereafter by the ink head 1, so that the two liquids are overlapped and attached to the print medium, and a printed image having a satisfactory quality can be obtained. The image quality of the thus obtained image is superior, as are its anti-bleeding, color reproduction and water repellency qualities.

However, during printing, the ink and the reaction liquid splash back, off the printing medium, and are mixed on the face surface of the ink head 1, where they generate a reaction product.

Figure 4:
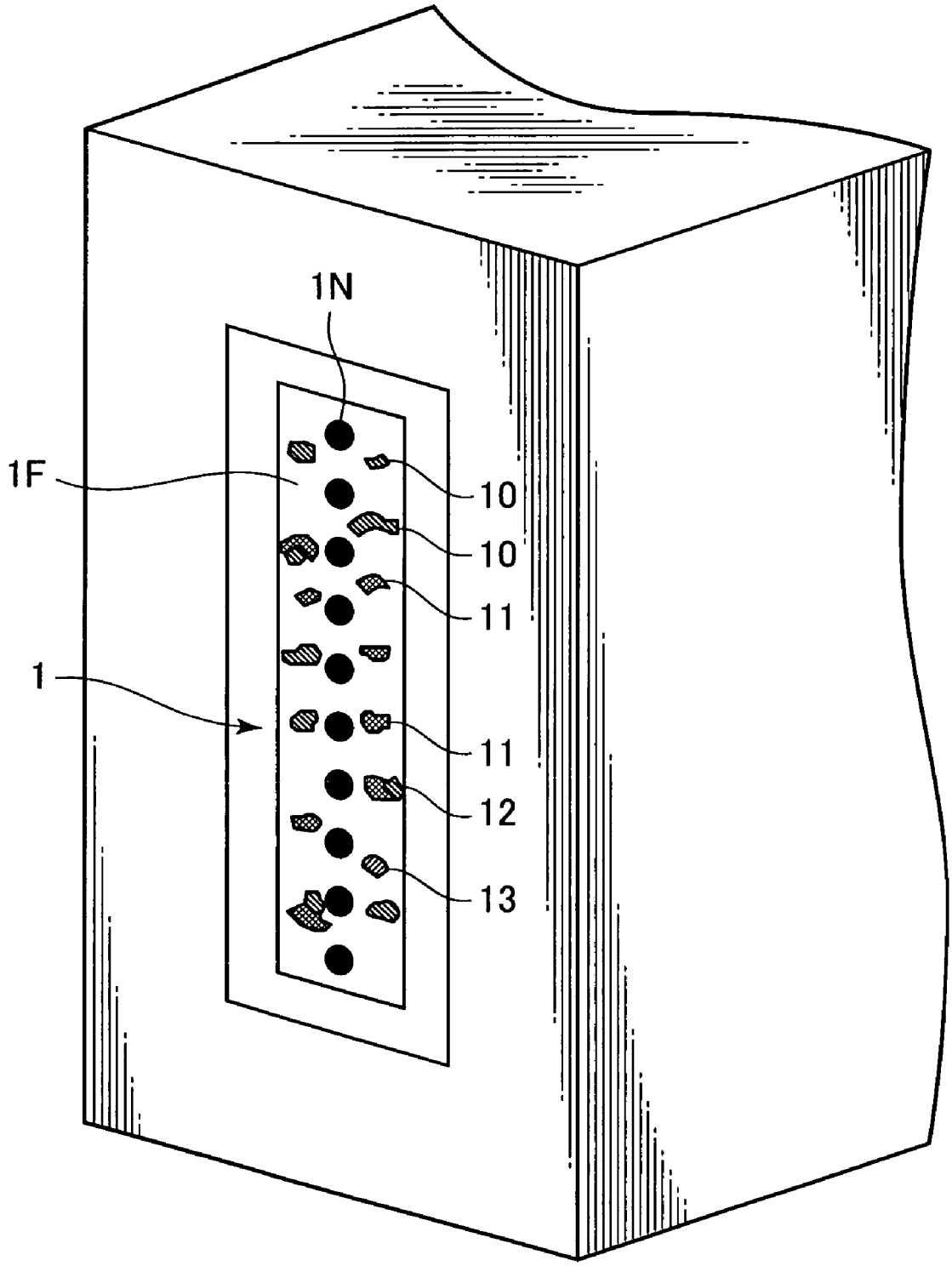
FIG. 4 is a diagram for explaining stains, such as those produced by coagulated products, on the face surface of an ink discharge head following the performance of printing.

FIG. 4 is a specific diagram showing examples of stains, such as are produced by a reaction product, on the face surface of an ink head 1 through which ink is discharged. The stains in FIG. 4 are produced by a reaction product 10 generated by reaction liquid and ink, an ink 11 and a reaction liquid 13, which are attached to a face surface 1F, and an ink stain 12 that has grown around the reaction product. As is shown in FIG. 4, when a reaction liquid and ink are employed, stains such as those produced by a reaction product may be formed on a face surface.

Figure 5:
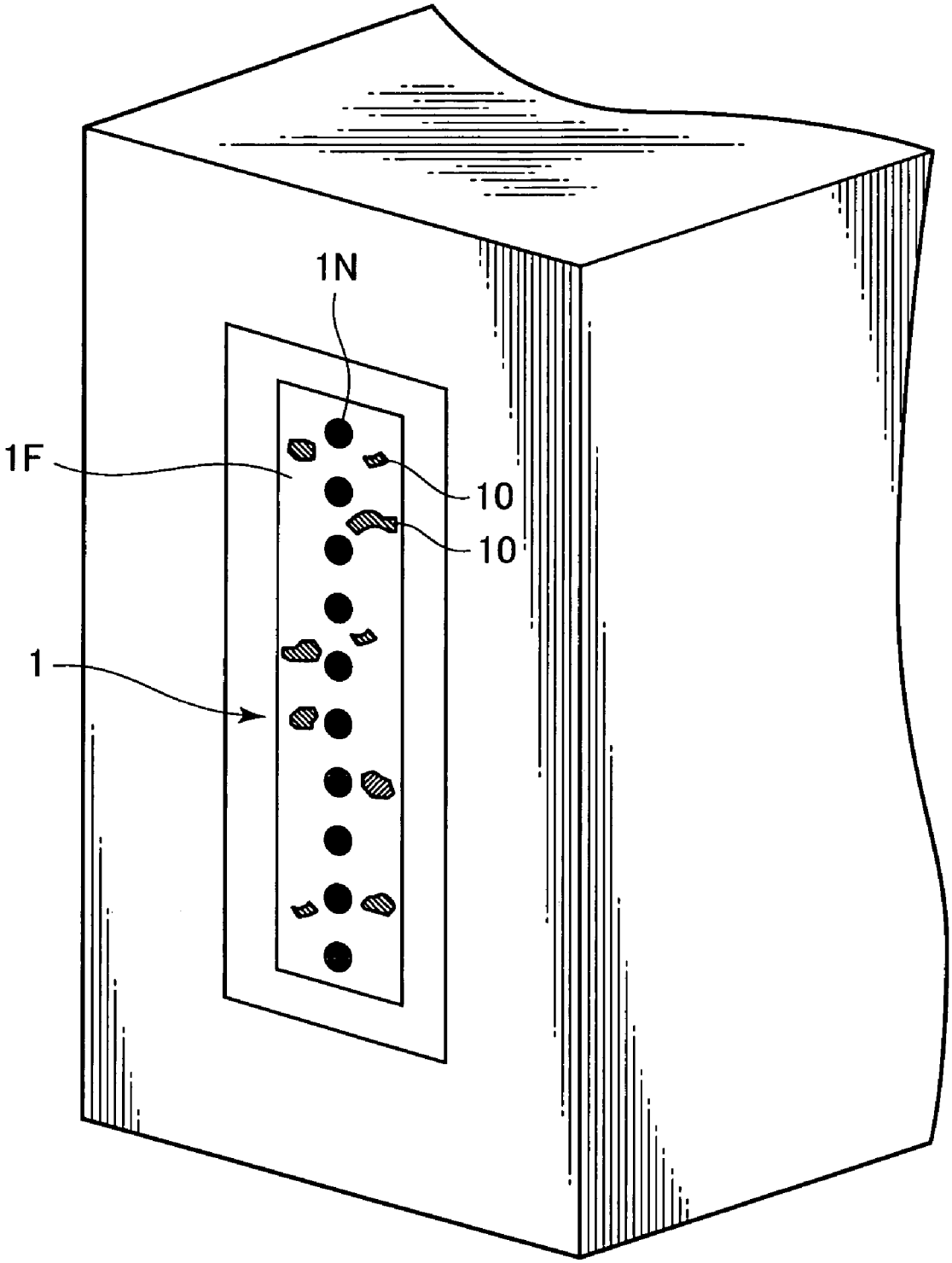
FIG. 5 is a diagram showing the conventional results obtained by cleaning the face surface.

To resolve this problem, conventionally, after the recording operation has been completed, or following the recording of a predetermined amount of data, a solution liquid is applied to the face surface to dissolve the generated reaction product on the face surface, and the dissolved product is removed by wiping (see Japanese Patent Laid-Open Publication No. Hei 10-151759). However, when the liquid solution is applied, it does not fully dissolve the reaction product; a large part of it remains and is difficult to remove by wiping. As is shown in FIG. 5, once a reaction product is generated and is partially coagulated, the conventional wiping operation cannot remove it completely, and the recovery to a satisfactory state for the face surface is difficult.

In this embodiment, therefore, before the printing operation is started, an anti-coagulation liquid, which suppresses the generation of a reaction product, is applied to the face surface. The printing operation is then initiated, while the anti-coagulation liquid is being applied to the face surface. When the printing operation for processing a predetermined amount of data, or for a predetermined period is completed, the recovery process is performed, i.e., ink or stains are removed from the face surface by wiping. After the recovery process has been completed, and when there are still data to be printed, the printing operation is resumed. In this case also, as is described above, the anti-coagulation liquid is again applied to the face surface before the printing.

Figure 6:
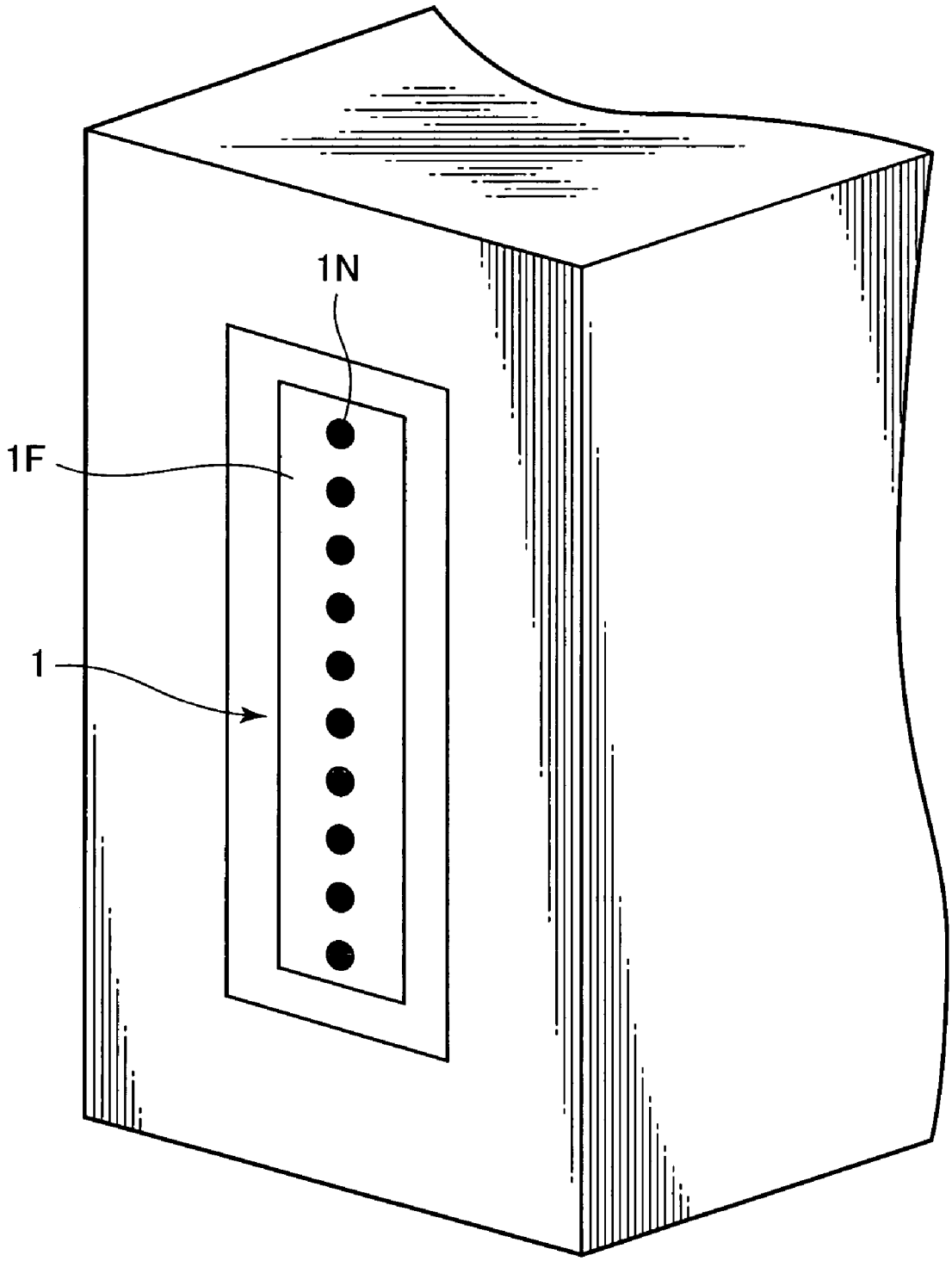
FIG. 6 is a diagram showing the results obtained by cleaning the face surface while employing a recovery process that uses an anti-coagulation liquid according to the invention.

FIG. 6 is a diagram showing example results obtained by wiping the face surface using recovery means that employ the anti-coagulation liquid according to this embodiment. When anti-coagulation liquid 1, 2 or 3, shown in Table 1 below, is applied in advance to the face surface to avoid the generation of a reaction product during the recording operation, stains on the face surface can be fully removed by wiping performed thereafter. As is also described above, the anti-coagulation liquid used for the invention is a liquid that prevents or suppresses a reaction product (an insoluble product or a flocculated product) generated by the reaction of ink with a reaction liquid (rendering them insoluble or flocculated). The anti-coagulation liquid also functions to prevent the reaction product generated on or attached to the face surface from coagulating on the face surface.

In Table 1, the anti-coagulation liquids 1 and 3 contain strong surfactants (BC40 and BC20 (both made by Nikko Chemicals Co., Ltd.)). When pigment ink is employed, the surfactant is attached around the pigment, so that the pigment rarely reacts, especially with the reaction liquid. Therefore, so long as the anti-coagulation liquid 1 or 3 that contains the surfactant is applied to the face surface in advance, when an ink mist, produced by a recording operation, that is floating in the air is attached to the face surface, the reaction of ink with reaction liquid attached thereafter can be prevented or suppressed. As a result, generation of a reaction product on the face surface can be effectively prevented or suppressed.

The anti-coagulation liquids 1 and 2 in Table 1 can dissolve ink or a reaction product. Therefore, so long as the anti-coagulation liquid 1 or 2 is applied to the face surface in advance, ink or reaction liquid that, as a result of a discharge operation, is floating in the air and is attached to a face surface, is dissolved, so that the generation of a reaction product can be prevented or suppressed. Furthermore, if a reaction product is attached to a face surface, the portion that contacts the face surface is dissolved. As a result, the coagulation of the reaction product on a face surface can be prevented.

TABLE 1

| | element | chemical formula | % |
|---|---|---|---|
| anti-coagulation liquid 1 | BC40 (Nikko Chemical Co., Ltd.) | C16H32(CH2CH2O)40H | 10% |
| | ethylene glycol | HO(CH2)2OH | 20% |
| | sodium hydroxide | NaOH | 1% |
| | ion exchanger | H2O | remaining portion |
| anti-coagulation liquid 2 | 2-pyrrolidone | C4H7NO | 60% |
| | triethanolamine | (HOCH2CH2)3N | 10% |
| | sodium hydroxide | NaOH | 1% |
| | ion exchanger | H2O | remaining portion |
| anti-coagulation liquid 3 | hexylene glycol | HO(CH2)6O | 50% |
| | BC20 (Nikko Chemical Co., Ltd.) | C16H32(CH2CH2O)20H | 10% |
| | ion exchanger | H2O | remaining portion |

Anti-coagulation liquids other than those shown in Table 1 can also be employed. For example, a nonionic surfactant having five or more ethylene oxide groups can be employed. Further, a water-soluble organic solvent used by mixing with water can be, for example, an alkyl alcohol for which the carbon number is one to four, such as methyl alcohol, ethyl alcohol, n-propyl alcohol, isopropyl alcohol, n-butyl alcohol, sec-butyl alcohol or tert-butyl alcohol; an amide, such as dimethylformamide or dimethylacetamide; ketone or a keto-alcohol, such as diacetone alcohol; an ether, such as tetrahydrofuran or dioxane; a polyalkylene glycol, such as polyethylene glycol or polypropylene glycol; an alkylene glycol that contains carbon atoms having two to six alkylene groups, such as ethylene glycol, propylene glycol, butylenes glycol, triethylene glycol, 1,2,6-hexanetriol, thiodiglycol, hexylene glycol or diethylene glycol; a glycerol; a lower alkyl ether of polyhydric alcohol, such as ethylene glycol monomethyl (or monoethyl) ether, diethylene glycol monomethyl (or monoethyl) ether or triethylene glycol monomethyl (or monoethyl) ether; N-methyl-2-pyrrolidone; 2-pyrrolidone; or 1,3-dimethyl-2-imidazoledinone. Among these water-soluble organic solvents, a lower alkyl ether of polyhydric alcohol, such as diehylene glycol, or of polyhydric alcohol, such as triethylene glycol monomethyl (or monoethyl) ether is preferable. Or, a polar solvent, such as formaldehyde, 2-pyrrolidone, hexylene glycol, EG monoethyl ether, triethanolamine or 1,2,6-hexanetriol, or an alkaline solution, such as sodium hydroxide, lithium hydroxide or magnesium hydroxide, can be employed as the main element of the anti-coagulation liquid.

An apparatus that applies the above-described anti-coagulation liquid, and a liquid application method, will now be described.

First Embodiment

Figure 7:
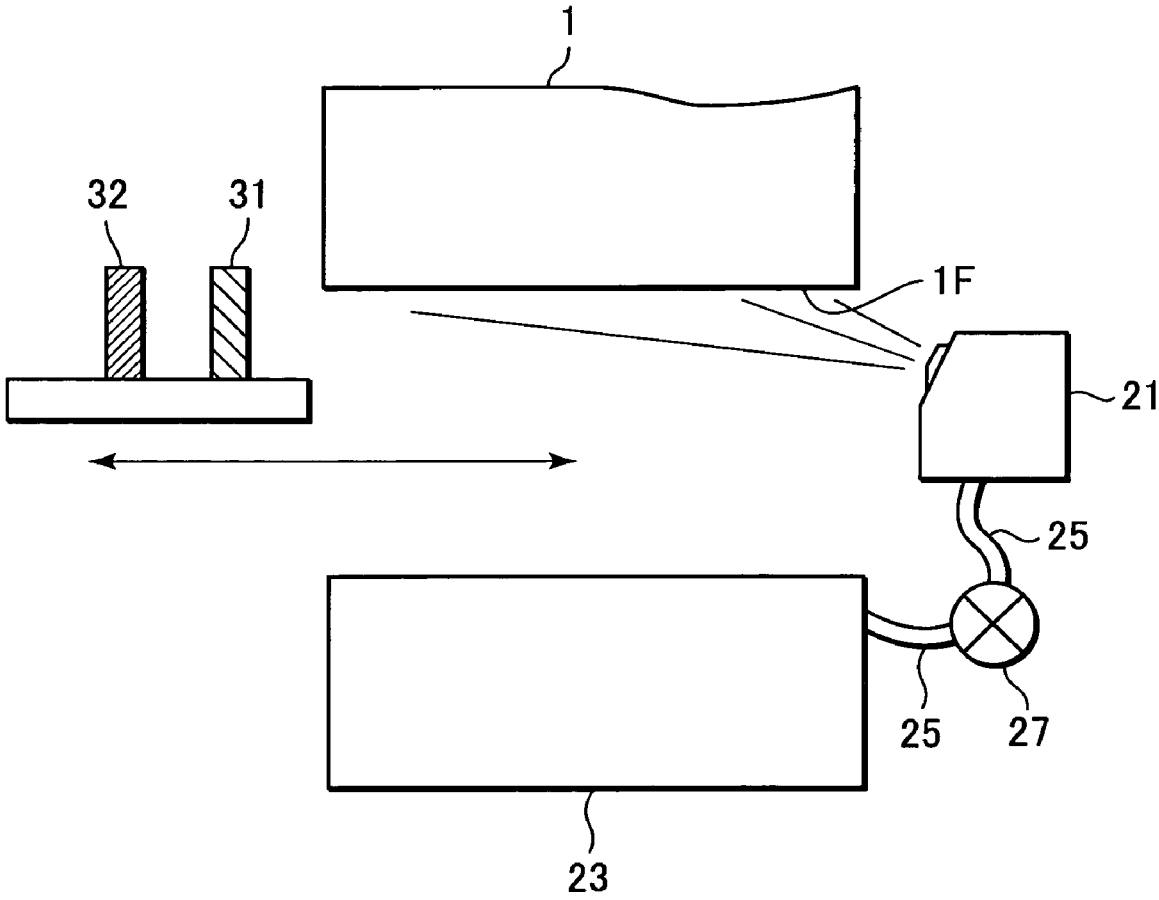
FIG. 7 is a specific diagram showing a recovery system that employs an anti-coagulation liquid spray according to a first embodiment of the present invention.

FIG. 7 is a specific diagram showing a discharge recovery arrangement according to a first embodiment of the present invention.

In FIG. 7, a spray device 21 is used to spray one of the anti-coagulation liquids in Table 1 on the face surface of the ink head 1, and an anti-coagulation liquid tank 23 is used to retain the anti-coagulation liquid. The anti-coagulation liquid retained in the anti-coagulation liquid tank 23 is supplied by a pump 27, through a supply pipe 25, to the spray 21. The anti-coagulation liquid, sprayed on the face surface by the spray 21, is mixed with ink or reaction liquid that later will be attached to the face surface, and acts to prevent or suppress the generation of a reaction product. Further, the thus applied anti-coagulation liquid also acts to prevent a reaction product, which is generated on or attached to the face surface, from coagulating on the face surface.

In this embodiment, the above-described tank 23, the pump 27 and the spray device 21 are provided for the cleaning unit 106 shown in FIG. 3. However, so long as an anti-coagulation liquid can be properly supplied to the face surface, these components may be located on the main body side or on the head (the carriage) side.

Immediately before the printing operation is started, the anti-coagulation liquid is applied to the face surface of the ink head 1 by the spray device 21. The ink head 1, for which the anti-coagulation liquid has been applied to the face surface, is moved from the cleaning unit 106 and performs the printing operation. When the printing operation has been completed, or when printing has been performed for a predetermined period or for a predetermined amount of data, the ink head 1 returns to a discharge recovery mechanism in FIG. 7. That is, the ink head 1 is moved to the left in FIG. 7 and the face surface is wiped by two wiper blades 31 and 32 to remove ink, the reaction liquid and the anti-coagulation liquid that was employed to prevent the generation of a reaction product. Even if reaction product is attached to the face surface, only a small amount of the product is generated, or the product is not strongly adhered to the face surface because of the action of the anti-coagulation liquid, so that the reaction product can be completely removed by the succeeding wiping operation.

In this embodiment, ether coupled urethane, 0.7 mm thick, is employed for the wiper blades 31 and 32. An arbitrary number of wiper blades may be employed, and instead of the wiper blades, a cleaning member using an absorption material or a porous material may be employed to rub the face surface of the ink head. In addition, the wiper blades may be formed of a thinner urethane than the one in this embodiment, or a material that is softer than urethane.

The anti-coagulation liquid may be sprayed not only on the ink head 1, but also on the reaction liquid head 2 because the reaction product composed of ink and reaction liquid may also be generated on the face surface of the reaction liquid head 2. When the anti-coagulation liquid is sprayed to both the ink head 1 and the reaction liquid head 2, different wiper blades may be employed for the ink head and the reaction head, or the same wiper blades may be employed in common. When the same wiper blades are used to clean both heads, the ink or the reaction liquid that was removed first may adhere to the face surface of the ink head or the reaction liquid head that is to be cleaned next, and a reaction product may be generated on the face surface. However, since the anti-coagulation liquid is sprayed before the next printing operation is started, the reaction product can be easily removed by the anti-coagulation liquid, and it is less probable that the reaction product will remain on the face surface. Therefore, there is no problem in the use of the wiper blades in common, in order to maintain the satisfactory condition of the face surface.

Likewise, the parts used for another recovery process need not be provided separately for the reaction liquid head 2 and the ink head 1. For example, a cap large enough to cover both heads may be employed to perform suction for both heads at the same time. If a reaction product is generated in the cap and is adhered to the face surface, the reaction product is dissolved by the anti-coagulation liquid that is applied later. Therefore, there is less possibility that the reaction product will coagulate on the face surface, and the printing operation will not be adversely affected.

With the above described structure, since when the anti-coagulation liquid is properly applied to the face surface, the coagulation of the reaction product on the face surface can be prevented, a clean face surface can be maintained. Furthermore, since the wiper blades and the cap can be employed in common for the ink head and the reaction liquid head, the structure of the apparatus can be simplified and the cost can be reduced.

When an ink jet printing apparatus has a plurality of printing modes, such as a normal printing mode using only ink and a special printing mode using both ink and a reaction liquid, conventionally, more repetitions for wiping are required in the special printing mode than in the normal printing mode. However, according to the invention, since it is difficult for the reaction product to be generated on the face surface, a strong wiping force is not required, and the number of wiping repetitions need not be changed between the normal printing mode and the special printing mode, i.e., the same control process can be performed. Therefore, the control process sequence can be simplified. As is described above, according to this embodiment, since the reaction product adhered to the face surface can be easily removed, the force required for wiping and the number of wiping repetitions can be reduced, compared with those in the conventional case. As a result, the face surface can be protected from being damaged, and the durability of the ink jet head can be increased.

Similarly, for another recovery process, such as a suction recovery process, the number of repetitions need not be changed for the normal printing mode and the special printing mode, and the same number of repetitions can be employed for both modes. Or, as is described above, the suction recovery process may be performed while the two heads are closed by a single cap at the same time. Therefore, the control sequence can be simplified.

Table 2 below shows the results of a comparison of the printing quality between the first embodiment and a conventional example. In Table 2, ○ denotes a condition wherein no problem in the printing quality can be found through visual observation. Δ denotes a condition wherein the printing quality is a little poorer but can be practically used. x denotes a condition wherein the printing quality is at a level lower than the previous two.

TABLE 2

| | | image quality | | | |
|---|---|---|---|---|---|
| | printing count (sheets) | conventional example | anti-coagulation liquid 1 | anti-coagulation liquid 2 | anti-coagulation liquid 3 |
| 100% duty printing | 1 | ○ | ○ | ○ | ○ |
| | 5 | Δ | ○ | ○ | ○ |
| | 10 | X | ○ | ○ | ○ |
| | 15 | X | ○ | ○ | ○ |
| | 20 | X | ○ | ○ | ○ |
| | 25 | X | ○ | ○ | ○ |
| | 30 | X | ○ | ○ | ○ |

An explanation will now be given for a method used for this embodiment for adjusting black ink and a reaction liquid.

(Coloring Pigment Ink)

<Production of Pigment Dispersing Liquid> styrene-acrylate-ethyl acrylate copolymer (acid value 240, weight-average molecular weight=5,000) 1.5 part monoethanolamine 1.0 part diethylene glycol 5.0 parts ion exchanger 81.5 parts A mixture of these elements is heated in a water bath at 70° C. to completely dissolve the resin portion. Ten parts of new test-produced carbon black (MCF88 by Mitsubishi Chemical Corp.) and 1 part of isopropyl alcohol are added to the obtained solution, and after premixing is performed for 30 minutes, a dispersion process is performed under the following conditions.

dispersion machine: sand grinder (Igarashi Machinery Co., Ltd.)

grinding media: zirconium beads, diameter of 1 mm filling rate of grinding media: 50% (volume percentage)

grinding period: three hours

Further, a centrifugation process (12,000 rpm; 20 minutes) is performed to remove large particles, and the obtained liquid is used as a pigment dispersing liquid.

<Production of Coloring Pigment Black Ink K1>

The elements below are mixed by using the above dispersing liquid at the following composition ratio, and the thus obtained ink, containing a pigment, is used as a coloring pigment ink. The surface tension at this time is 34 mN/m.

the above described pigment dispersing liquid 30.0 parts
glycerol 10.0 parts
ethylene glycol 5.0 parts
N-methyl-pyrrolidone 5.0 parts
ethyl alcohol 2.0 parts
acetylenolEH (Kawaken Fine Chemicals Co., Ltd.) 1.0 part
ion exchanger 47.0 parts (Reaction Liquid S1)

Then, a mixture of the following elements is dissolved, and is filtered under pressure by a membrane filter (a Fluoropore filter by Sumitomo Electric Industries, Ltd.). As a result, a reaction liquid S1 whose pH is adjusted to 3.8 is obtained.

Figure 8:
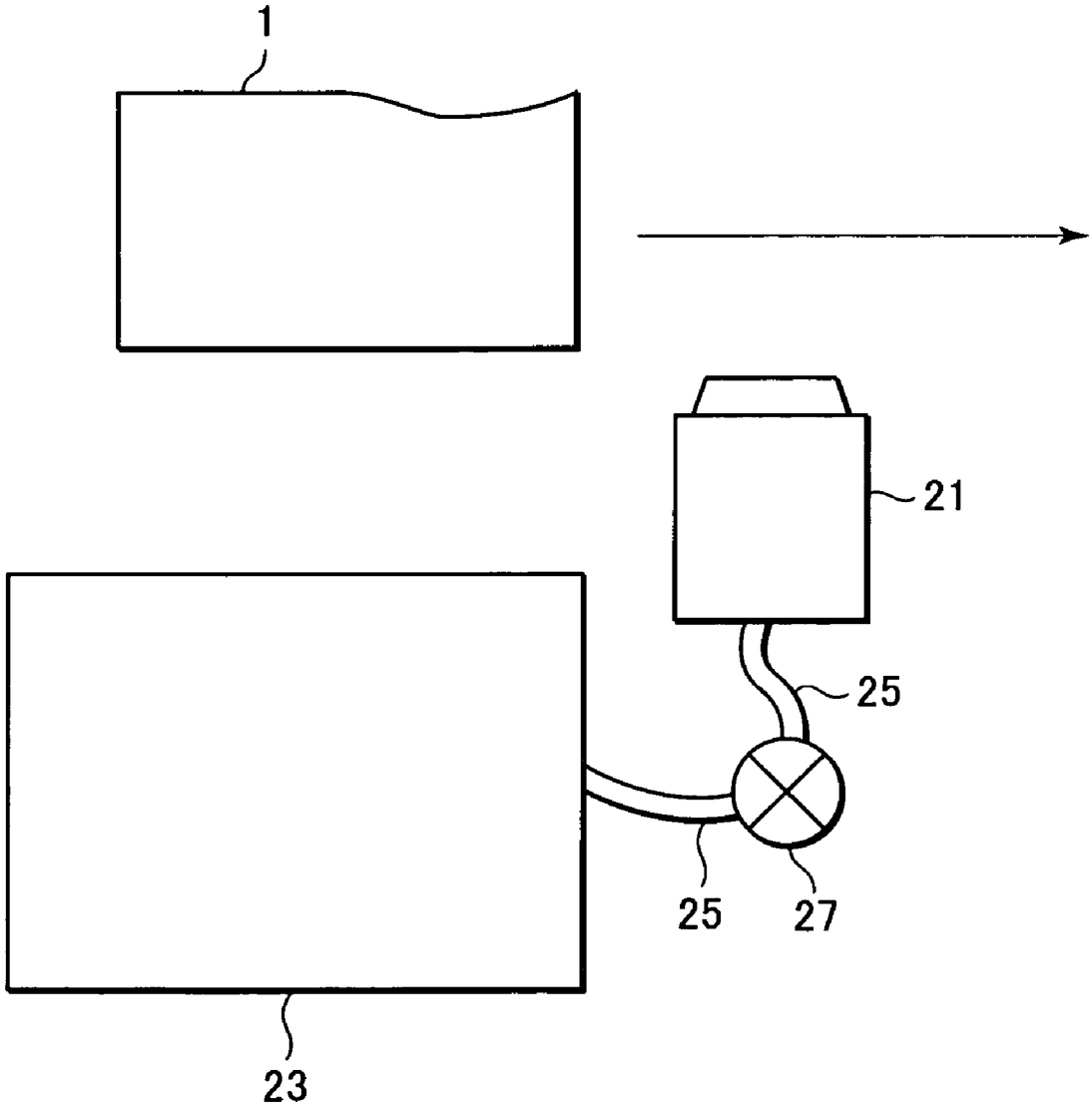
FIG. 8 is a specific diagram showing a modification of the recovery system that employs the spray for the first embodiment.

<Composition of Reaction Liquid S1>
diethylene glycol 10.0 parts
methyl alcohol 5.0 parts
magnesium nitrate 3.0 parts
acetylenolEH (Kawaken Fine Chemicals Co., Ltd.) 0.1 part
ion exchanger 81.9 parts FIG. 8 is a specific diagram showing another example structure for supplying an anti-coagulation liquid using a spray. As is shown in FIG. 8, the spray device 21 is located within a range within which the ink head 1 is moved, but outside the printing area, so that the anti-coagulation liquid is sprayed when the ink head 1 is moved to the location opposite the spray device 21. In this manner, the face surface to which the anti-coagulation liquid is to be applied can be easily selected, and the anti-coagulation liquid can be uniformly applied.

As is described above, according to this embodiment, before printing is performed using ink and a reaction liquid, the anti-coagulation liquid is applied in advance to the face surface so as to act on the ink, the reaction liquid and the reaction product that are adhered to the face surface. As a result, the original generation of the reaction product can be prevented or suppressed, or even when a reaction product is generated on the face surface, coagulation of this product on the face surface can be prevented, and a clean face surface can be maintained.

Second Embodiment

Figure 9:
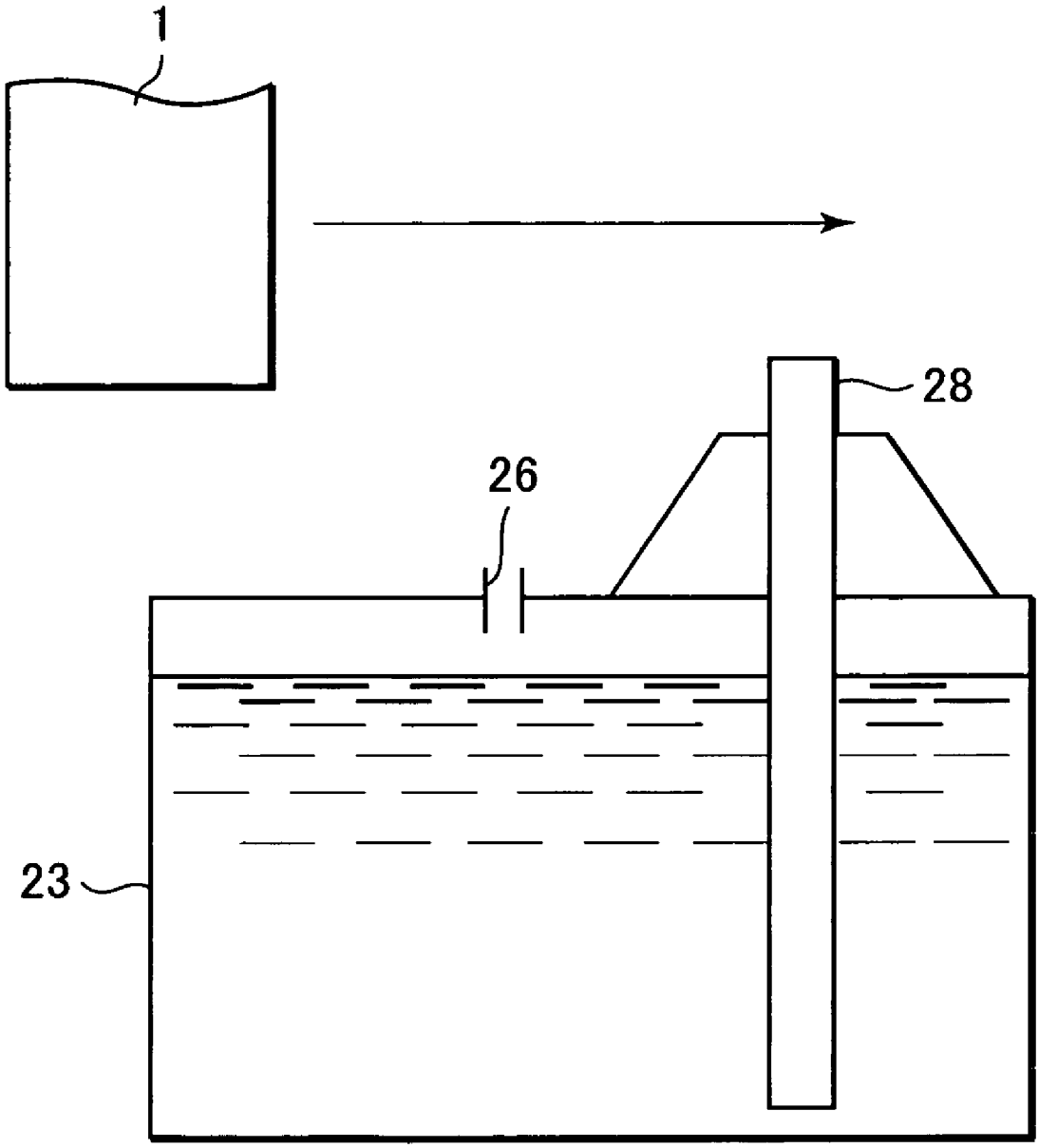
FIG. 9 is a specific diagram showing a recovery system that employs a capillary attraction force according to a second embodiment of the present invention.

FIG. 9 is a specific diagram showing a structure according to a second embodiment of the present invention for applying an anti-coagulation liquid.

A core 28 having a comparatively large capillary attraction force is arranged in an anti-coagulation liquid tank 23 and partially projected therefrom. An air hole 26 communicating with the atmosphere is also formed in the tank 23. That is, an anti-coagulation liquid permeates the entire core 28 using capillary attraction. And one end of the core 28 is positioned outside the printing area of an ink head 1 and within the range wherein the ink head 1 is moved, so that the end can rub against the face surface of the ink head 1. With this arrangement, not only can the anti-coagulation liquid be easily applied to the face surface, but also a stain, which could not be removed from the face surface by wiping performed after the preceding recording operation, can be scraped off by the rubbing operation.

In this case, while taking into account the application of the solution, the efficiency for the coating of the face surface and the scraping effects, various shapes can be employed for the core 28, e.g., the portion in contact with the anti-coagulation liquid may be extended, or the distal end of the core may be shaped like a wedge or a brush. In this embodiment, urethane foam is employed as a core material; however, various other materials may be employed, such as felt, cloth, sponge or a combination of them.

Figure 10:
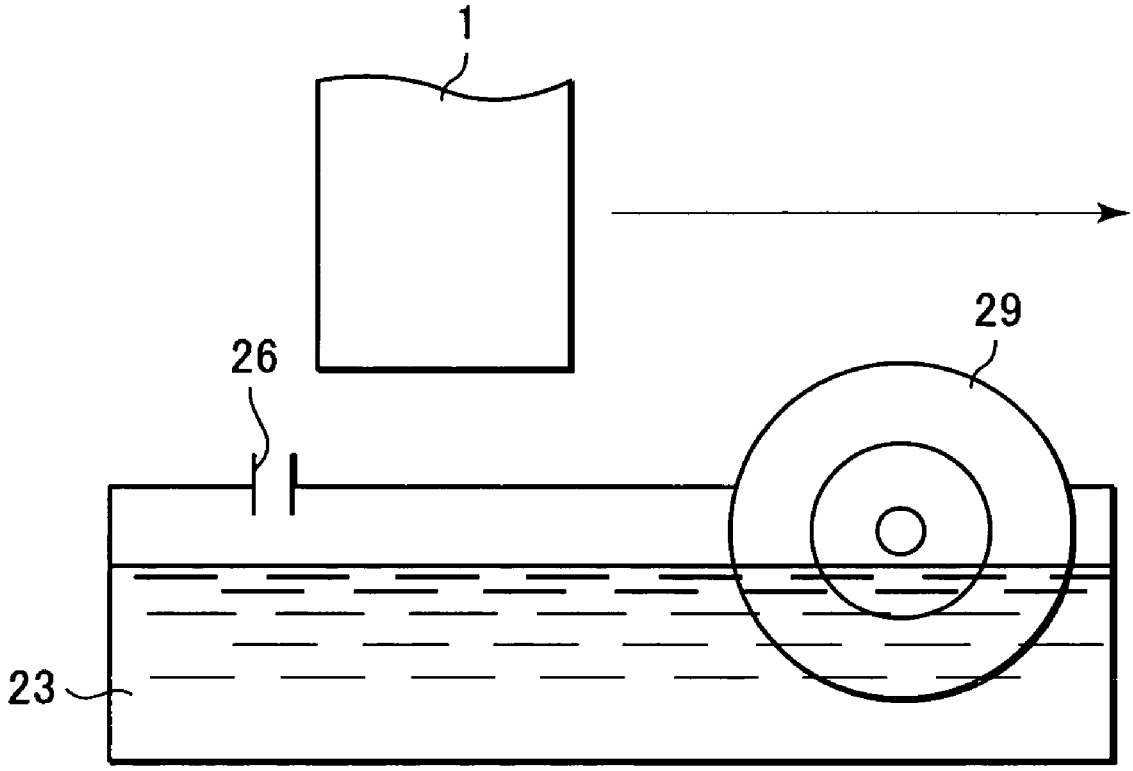
FIG. 10 is a specific diagram showing another example recovery system that employs a capillary attraction force for the second embodiment.

FIG. 10 is a specific diagram showing another example for the application of an anti-coagulation liquid by capillary attraction. In FIG. 10, a roller 29 is either entirely formed of a material, such as urethane foam, that can hold an anti-coagulation liquid, or is obtained by covering the surface with urethane foam. When, as in the example in FIG. 10, the roller 29 can be slid as the ink head 1 is moved, the anti-coagulation liquid can be appropriately applied to the face surface.

Figure 11:
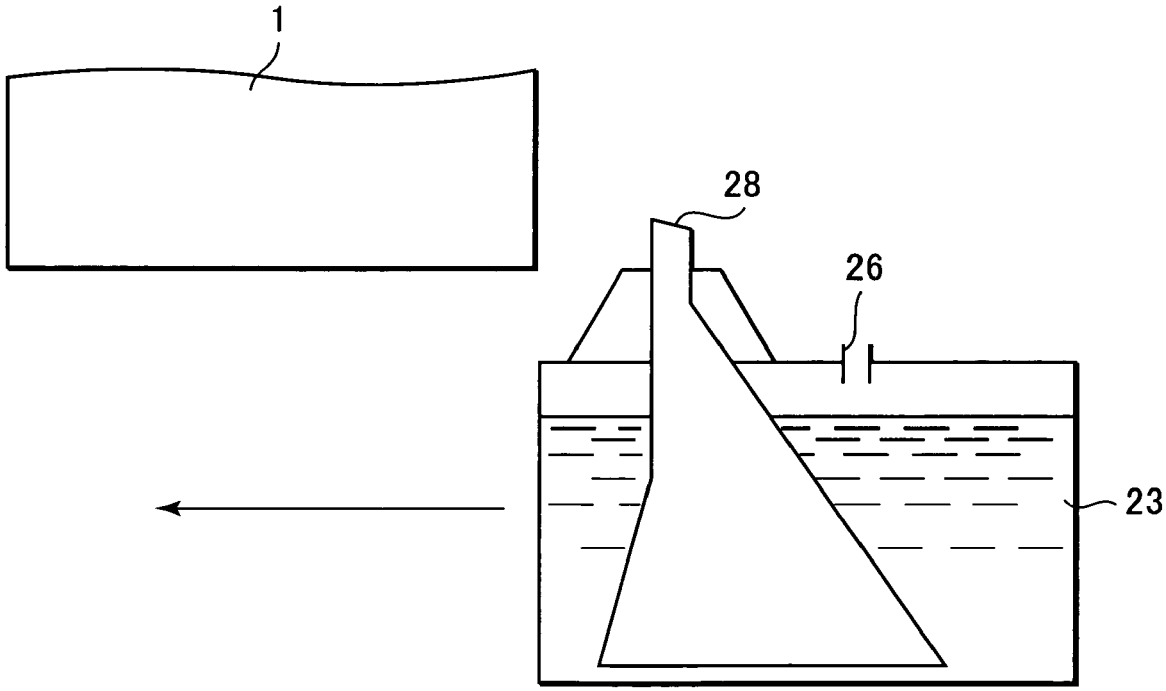
FIG. 11 is a specific diagram showing an additional example recovery system that employs a capillary attraction force according to the second embodiment.

FIG. 11 is a diagram showing an additional example for this embodiment wherein the core 28 is movable for the application of an anti-coagulation liquid. This structure can be employed when the discharge recovery process is to be performed with the ink head being fixed, or when the face surface is to be rubbed in a direction differing from that in which the carriage is moving. The example in FIG. 11 is an application of the example in FIG. 9; however, the example in FIG. 10 can also be modified to provide the example in FIG. 11.

When the printing is performed by using the structure shown in FIG. 10 or 11, and the face surface is wiped by the wiper blades, the anti-coagulation liquid need only be reapplied, and the face surface cleaned. For example, after the printing and wiping have been completed, the anti-coagulation liquid is applied by the core or the roller, and the little reaction product remaining on the face surface will be dissolved by the dissolving action of the anti-coagulation liquid. Then, the wiping and a preliminary discharge of 500 droplets are performed to remove the stains adhered to the face surface. The results obtained after this process is performed and the results obtained by a conventional example, used as a comparison, are shown in Table 3.

The printing results provided by the conventional example are obtained after a conventional recovery process has been performed without using an anti-coagulation liquid. A first example (printing is performed using the structure in FIG. 10) and a second example (printing is performed using the structure in FIG. 11) show the printing results obtained when performing the above-described process, wherein an anti-coagulation liquid is re-applied after the wiping has been performed.

In these examples, an image printed through a series of processes is visually observed. ○ denotes that there is no problem in the printing quality. Δ denotes that the printing quality is slightly poorer but at an adequate level for practical use. x denotes the printing quality is lower than the previous two.

TABLE 3

| | | image quality | | |
|---|---|---|---|---|
| | printing count (sheets) | conventional example | first example | second example |
| 100% duty printing | 1 | ○ | ○ | ○ |
| | 2 | ○ | ○ | ○ |
| | 3 | Δ | ○ | ○ |
| | 4 | Δ | ○ | ○ |
| | 5 | Δ | ○ | ○ |
| | 6 | X | ○ | ○ |

TABLE 3-continued

| | image quality | | |
|---|---|---|---|
| printing count (sheets) | conventional example | first example | second example |
| 7 | X | ○ | ○ |
| 8 | X | ○ | ○ |

As is shown in Table 3, in the first and second examples wherein the above described process is performed, even the number of prints is increased, the recording quality is not deteriorated and satisfactory printing results are maintained.

Third Embodiment

According to this invention, in order to prevent or suppress the generation of a reaction product, the anti-coagulation liquid is applied to the face surface of the ink head immediately before the recording operation is initiated. However, when the discharge port area is wet, this liquid tends to change the ink or reaction liquid discharge direction, i.e., it is possible that "deflection" will occur. Therefore, in this embodiment, on the face surface of the ink head, the wetting differs between the discharge port area and the other areas, and water repellency is increased only in the discharge port area. With this arrangement, the anti-coagulation liquid is applied to the face surface, except for the discharge port area, and the ink or reaction liquid discharge direction is not adversely affected by the anti-coagulation liquid.

Since the discharge port area is highly water repellent, even though the anti-coagulation liquid has not been applied, it is difficult for splashed ink or reaction liquid, or a reaction product to adhere to the discharge port area. Even when a reaction product is generated in the periphery of the discharge port during a recording operation, the reaction product is removed by the force with which the ink or the reaction liquid is discharged from the discharge port. Furthermore, since the ink or the reaction liquid is discharged at short intervals, even when ink or reaction liquid that is floating in the air is adhered near the discharge port, there is little possibility that a reaction product adhered to the face surface be coagulated.

In this embodiment, the mechanism for applying the anti-coagulation liquid and the printing mechanism are the same as those for the first and second embodiments. However, the face surface of the ink head is different, and the discharge port area is made of a highly water-repellent material. An explanation will now be given of an ink jet recording head manufacturing method according to the embodiment, and the structure of the face surface of the ink jet recording head.

(Example for Head Manufacturing)

FIGS. 12A to 12D and 13A to 13D are diagrams for explaining the individual steps in the head manufacturing method of the third embodiment.

Figure 12A:
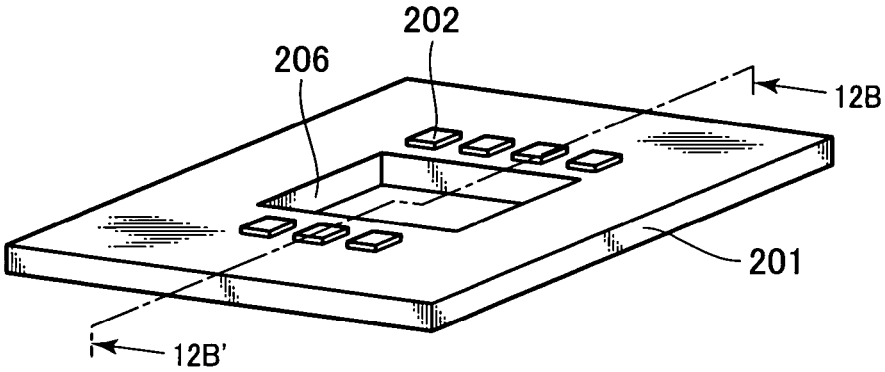
FIGS. 12A-12D are diagrams for explaining a head manufacturing process according to a third embodiment of the present invention.

As is shown in FIG. 12A, a blast mask is arranged on a silicon substrate 201 whereon a plurality of electrothermal converting elements 202 (heaters made of a material such as HfB2) are formed as liquid discharge energy generating elements, and using sand blasting, a through-hole 206 (ink supply port) is formed to supply ink.

Figure 12B:
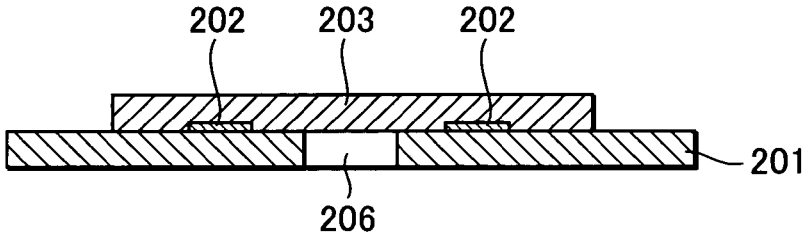

Then, as is shown in FIG. 12B, which includes a cross-section of FIG. 12A along section line 12B-12B', a dissoluble resin layer 203 is transferred to the substrate 201 by laminating. The dissoluble resin layer 203 is a dry film obtained by coating and drying polymethyl isopropenyl ketone (product name: ODUR-1010 by Tokyo Ohka Kogyo Co., Ltd.) on a PET (polyethylene terephthalate) sheet. Since ODUR-1010 has a low viscosity and cannot be formed as a thick film, a concentrate of this material is employed in this embodiment.

Following this, the resultant substrate 201 is pre-baked at 120° C. for 20 minutes, and an exposure process is performed by using mask aligner PLA 520 (cold mirror CM290 (product name, by Canon Inc.)) to form a pattern for an ink flow path. In this example, the exposure is performed for 1.5 minutes, and a spray development process is performed using a 1% caustic soda solution. A pattern 203 formed of the dissoluble resin is used to obtain the ink flow paths that connect the ink supply port 206 and the electro-thermal converting elements 202. In this embodiment, the actual thickness of the resist film formed after the development process is 10 μm.

Figure 12C:
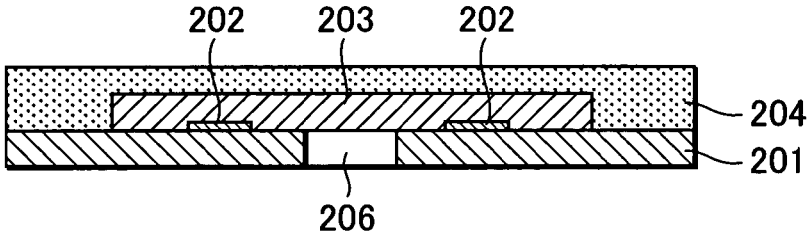

Next, as is shown in FIG. 12C, the following resin composition is dissolved in a solvent mixture of methyl isobutyl ketone and diglime, and a photosensitive covering resin layer 204 is formed by spin coating. In this example, the actual thickness of the resin layer 204 on the pattern 203 is 10 μm.

The composition of the photosensitive covering resin layer 204 is epoxy resin EHPE-3150 (product name, by Daicel Chemical Industries, Ltd.), cheminocs AFEp (product name, by Nippon Mectron Co., Ltd.), diol 1,4-HFAB (product name, by Central Glass Co., Ltd.), silane coupling agent A-187 (product name, by Nippon Unicar Co., Ltd.) and photo polymerization initiator adecaoptomer SP-170 (product name, by Asahi Denka Kyogyo K.K.).

Figure 12D:
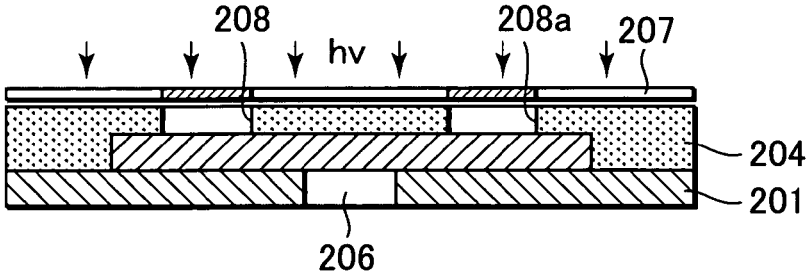

Thereafter, the pattern exposure process is performed using the PLA520 (CM250) to expose the water retention area through a mask 207. In this example, as is shown in FIG. 12D, the dotted portion of the photosensitive covering resin layer 204 is exposed. In this embodiment, the exposure process is performed for ten seconds, and the after-bake process is performed at 60° C. for 30 minutes.

Sequentially, a water-repellent, photosensitive surface treatment agent 205 having the following composition is dissolved in a diglime solvent, and the obtained solvent solution is applied by spray coating. Further, the pattern exposure is performed through a mask 207' by using the PLA250 (CM250).

Figure 13A:
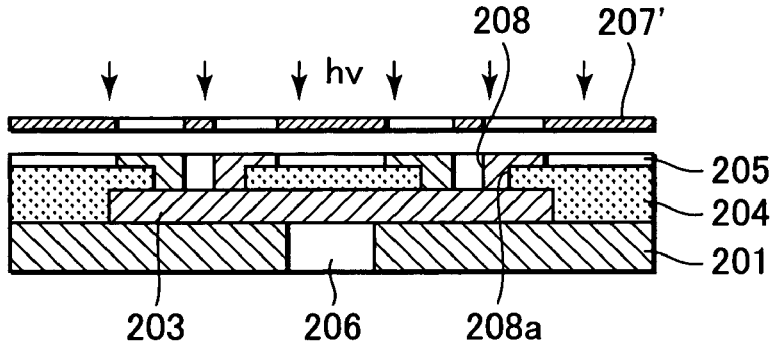
FIGS. 13A-13D are diagrams for further explaining the head manufacturing process according to the third embodiment.

That is, as is shown in FIG. 13A, the hatched portion of the photosensitive surface treatment agent 205 and the additional dotted portion of the photosensitive covering resin layer 204 are exposed.

Figure 13B:
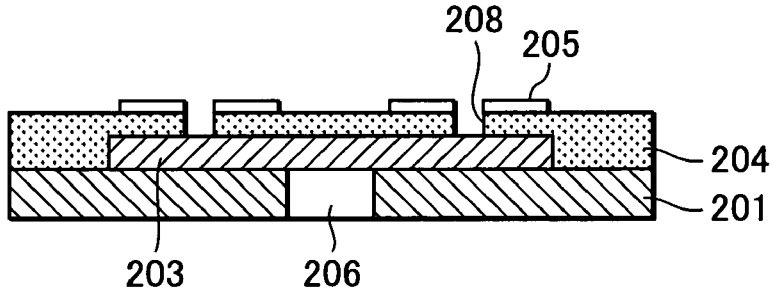

Then, as is shown in FIG. 13B, a development process is performed using methyl isobutyl ketone, and ink discharge ports 208, a water repellent pattern and a water retention area are obtained.

It should be noted that in this embodiment discharge ports 208*a* of ϕ26 μm are formed.

(Photosensitive Surface Treatment Agent 205)

The composition of the photosensitive surface treatment agent 205 is epoxy resin EHPE-3150 (product name, by Daicel Chemical Industries, Ltd.), cheminox AFEp (product name, by Nippon Mektron, Ltd.), diol 1,4-HFAB (product name, by Central Glass Co., Ltd.), MF-120 (product name, by Tokem Co., Ltd.), silane coupling agent A-187 (product name, by Nippon Unicar Co., Ltd.) and photo polymerization initiator adecaoptomer SP-170 (product name, by Asahi Denka Kyogyo K.K.).

At this time, the ink flow path pattern 203 is still present.

Next, as is shown in FIG. 13B, the resultant structure is again exposed using the PLA520 (CM290) for two minutes, and the principal chain of the material of the ink flow path pattern 203 is decomposed. Thereafter, the obtained structure is immersed in methyl lactate while applying ultrasonic waves, and the remaining ink flow pattern 203 is eluted.

Then, the head is heated at 150° C. for one hour to completely cure the photosensitive covering resin layer 204 and the water-repellent surface treatment agent 205.

Figure 13C:
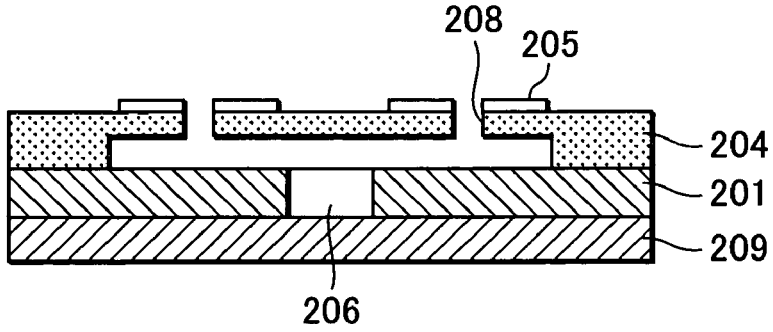

Finally, as is shown in FIG. 13C, an ink supply member 209 is bonded to the ink supply port 206. As a result, the ink jet recording head of the invention is completed.

Figure 13D:
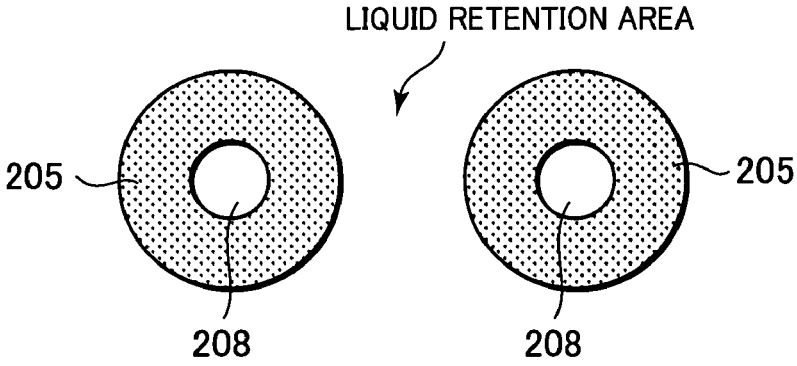

FIG. 13D is an enlarged front view of the discharge port area viewed from above in FIG. 13C.

As is shown in FIG. 13D, a liquid repellent area 205, having a doughnut shape where the water-repellent surface treatment agent is applied, is formed only around discharge ports 208, and the area of the face surface other than the liquid repellent area 205 is a liquid retention area. Therefore, when the anti-coagulation liquid is applied to the face surface, the doughnut-shaped liquid repellent area 205 repels the anti-coagulation liquid, and the discharge ports 208 are prevented form being wetted. Since the liquid retention area is made of a material having an appropriate wettability, the applied anti-coagulation liquid is held satisfactorily.

When the thus-obtained ink jet recording head is employed and an actual printing test is conducted using the above-described structure, ink or another liquid does not adhere, because of the liquid repellent area 205 around each discharge port 208, and further, ink or another liquid adhered to and retained in the external liquid retention area is prevented from moving to the discharge port 208. Therefore, the original discharge operation is not adversely affected.

As is described above, before the printing is started, the anti-coagulation liquid is applied to the entire face surface, without worrying about the occurrence of directional deviation of the ink discharge path, and even when the ink and the reaction liquid are mixed, the generation of an insoluble product or a flocculated product can be prevented or suppressed. Further, when the liquid mixture splashes off a printing surface and an insoluble product or a flocculated product adheres to the face surface, this adhered product can be dissolved. And since the face surface is rubbed in this state with the wiper blades 31 and 32, the coagulation, on the face surface, of the adhered product can be prevented, and a clean face surface can be maintained.

The material for forming the face surface is not limited to the material used in this embodiment, and any water repellent material can be employed for the liquid repellent area 205, and any wetting material can be employed for the liquid retention area. In this embodiment, the photosensitive surface treatment agent is employed to form the liquid repellent area 205; however, the present invention is not limited to this, and any method may be employed so long as both the liquid repellent area and the liquid retention area are formed on the face surface.

The head of this embodiment may be employed only as an ink discharge head or a reaction liquid discharge head, or as both heads. Naturally, it is most effective for the invention to be employed for both heads, so as to reduce the deviation of the discharge direction. However, the deviation of the discharge direction can be reduced even when the present invention is applied for only one head. Therefore, this embodiment includes a mode wherein the present invention is applied for either or both the ink discharge head and the reaction liquid discharge head.

Fourth Embodiment

Figure 14:
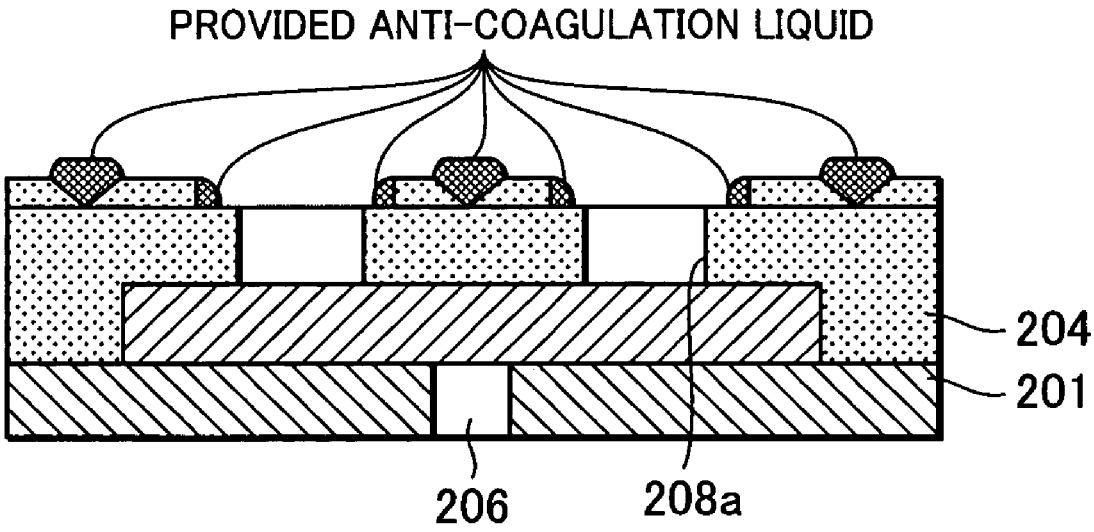
FIG. 14 is a diagram showing a head used for a fourth embodiment of the present invention.

A feature of a fourth embodiment is that, as shown in FIG. 14, steps and/or grooves are formed in the face surface of a head, and an anti-coagulation liquid is applied to the face surface and wiping is performed thereafter. According to this arrangement, as is shown in FIG. 14, the applied anti-coagulation liquid is drawn into the steps or the grooves and does not contact the discharge ports. Therefore, deviation of the discharge direction can be prevented because of the presence of the anti-coagulation liquid around the discharge ports. The fourth embodiment will now be described in detail.

The anti-coagulation liquid applying mechanism and the printing mechanism in this embodiment are the same as those for the first and second embodiments. The face surface of the head differs, however, and the steps or the liquid repellent grooves are formed around the discharge ports.

A method for manufacturing the head used for this embodiment will now be explained.

The first half of the head manufacturing processing is the same as that for the third embodiment. That is, since the steps up to FIG. 12D are the same, only the succeeding steps will be explained.

Figure 15:
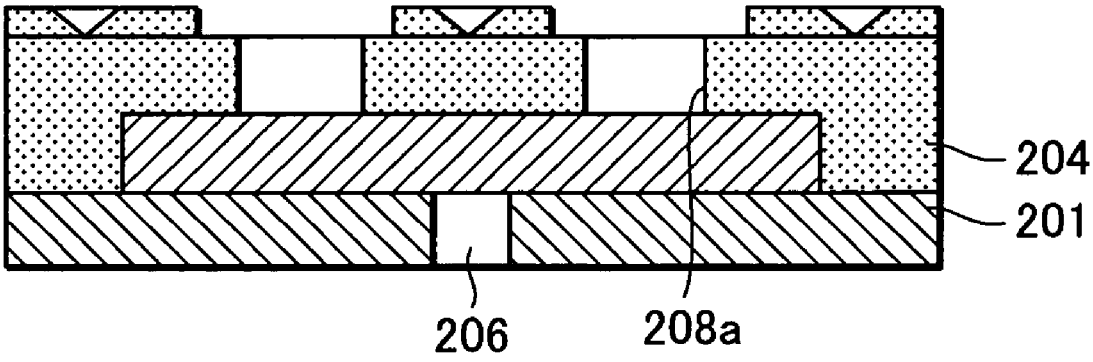
FIG. 15 is a diagram for explaining a head manufacturing process according to the fourth embodiment.

After the step in FIG. 12D, the same processes are performed using the same materials as those used in the steps in FIGS. 12C and 12D, and a step-shaped face surface shown in FIG. 15 is formed.

Sequentially, a water repellent, photosensitive surface treatment agent 205 (the same material as is used for the third embodiment is employed as a surface treatment agent) is dissolved in a diglime solvent, and the resultant solvent is applied by spray coating. Then, as shown in FIG. 13A, using the PLA520 (CM250) the pattern exposure process is performed through a mask 207'.

Figure 16A:
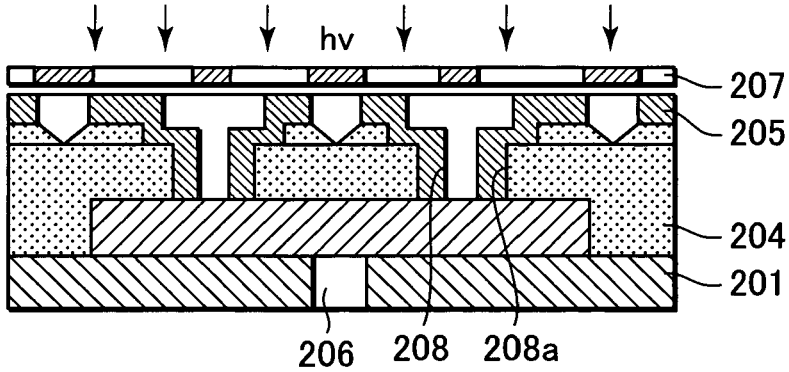
FIGS. 16A-16D are diagrams for explaining the head manufacturing process according to the fourth embodiment.

Next, as is shown in FIG. 16A, the development process is performed using methyl isobutyl ketone, and ink discharge ports 208, a liquid repellent pattern and a liquid retention area are obtained. In this embodiment, a discharge port pattern 208*a* of ϕ26 μm is formed. At this time, a liquid flow path pattern 203 is present.

Figure 16B:
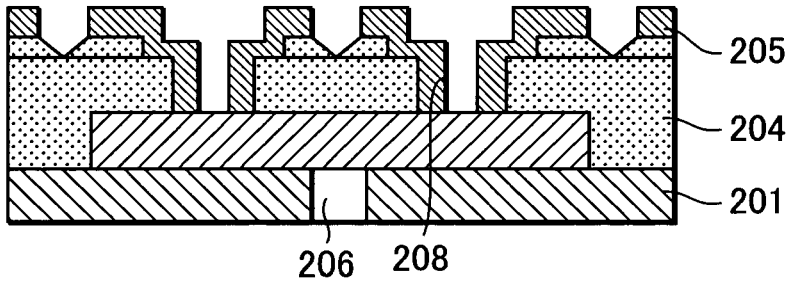

Following this, as is shown in FIG. 16B, the exposure process is performed again, using the PLA520 (CM290), for two minutes to decompose the principal chain of the material of the liquid flow path pattern 203. Then, the resultant structure is immersed in methyl lactate while applying ultrasonic waves, and the remaining liquid flow path pattern 203 is eluted. Following this, the head is heated at 150° C. for one hour to completely cure a photosensitive covering resin layer 204 and the water repellent surface treatment agent 205.

Figure 16C:
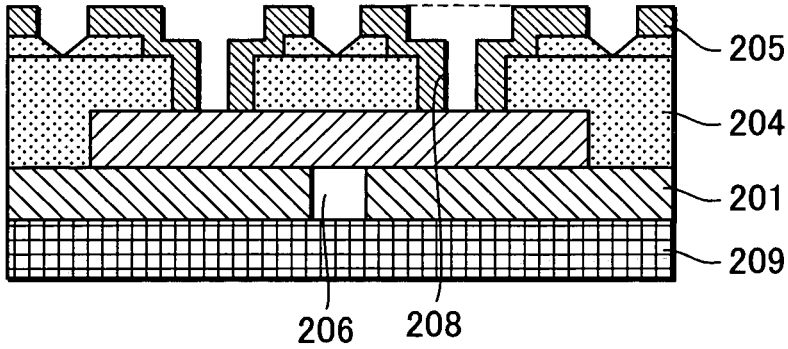
Figure 16D:
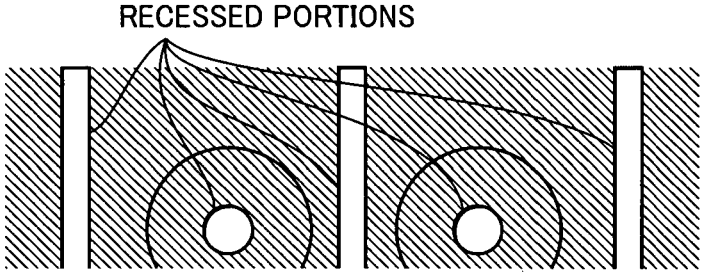

Finally, as shown in FIG. 16C, an ink supply member 209 is bonded to an ink supply port 206, and an ink jet recording head according to this embodiment is completed. FIG. 16D is an enlarged top view of FIG. 16B, viewed from the side of the discharge ports 208.

The ink jet printing apparatus as explained while referring to FIGS. 3 and 7 in the first embodiment performs printing using the thus-obtained ink jet recording head. Specifically, before a printing operation is begun, the anti-coagulation liquid is applied to the face surface of the head wherein the steps or the grooves are formed, and wiping is appropriately performed. Since the steps or grooves are present around the discharge ports 208, the anti-coagulation liquid applied near the discharge ports 208 is drawn into the steps or the grooves by wiping. According to this arrangement, a discharge operation is not performed while the anti-coagulation liquid is adhered to the discharge ports 208. Further, the droplets of a mist that adhere to the discharge ports 208, or ink that splashes off a print surface and is retained on the face surface, are drawn into the steps or the grooves, and are prevented from moving to the discharge ports 208. Thus, the original discharge operation is not adversely affected, and deviation of the discharge direction can be prevented.

An explanation will now be given for a method for adjusting ink, reaction liquid and anti-coagulation liquid that is employed for this invention. In the following description, part and % are per weight unless otherwise specified.

FIRST EXAMPLE

Color ink, i.e., black, cyan, magenta and yellow ink that contains a pigment and an anionic compound was prepared. A reaction liquid and an anti-coagulation liquid were also prepared.

Thirty sheets were continuously printed, at 100% duty by the ink jet printing apparatus explained in the first embodiment while referring to FIGS. 3 and 7, employing the ink, the reaction liquid and the anti-coagulation liquid described above. The obtained results will be described later while referring to Table 4.

(Color Ink K1)

The color ink K1 as explained in the first embodiment was prepared.

(Color Ink C1)

The color ink C1, containing a pigment, was produced in the same manner as was the color ink K1, except that the carbon black (MCF88, by Mitsubishi Chemical Industries, Ltd.) used for preparing the color ink K1 was replaced with blue pigment 15.

(Color Ink M1)

The color ink M1 containing a pigment was produced in the same manner as was the color ink K1, except that the carbon black (MCF88, by Mitsubishi Chemical Industries, Ltd.) used for preparing the color ink K1 was replaced with red pigment 7.

(Color Ink Y1)

The color ink Y1 containing a pigment was produced in the same manner as was the color ink K1, except that the carbon black (MCF88, by Mitsubishi Chemical Industries, Ltd.) used for preparing the color ink K1 was replaced with yellow pigment yellow 74.

(Reaction Ink S1)

The same reaction ink as explained in the first embodiment was prepared.

(Anti-Coagulation Liquid P1)

A mixture of the following elements was dissolved, and was filtered under pressure by using a membrane filter (product name: Fluoropore filter, by Sumitomo Electric Industries, Ltd.) having a pore size of 0.22 μm, to obtain the anti-coagulation liquid P1.

<Composition of Anti-Coagulation Liquid P1> diethylene glycol 10.0 parts methyl alcohol 5.0 parts

BC40 (Nikko Chemicals Co., Ltd.) 10.0 parts acetylenolEH (Kawaken Fine Chemicals Co., Ltd.) 0.1 part ion exchanger 74.9 parts

SECOND EXAMPLE

The printing operation was performed under the same conditions as in the first example, except that a different anti-coagulation liquid was used.

(Anti-Coagulation Liquid P2)

A mixture of the following elements was dissolved, and was filtered under pressure using a membrane filter (product name: Fluoropore filter, by Sumitomo Electric Industries, Ltd.) having a pore size of 0.22 μm, to obtain the anti-coagulation liquid P2.

<Composition of Anti-Coagulation Liquid P2> diethylene glycol 20.0 parts methyl alcohol 5.0 parts

EDTA (ethylenediaminetetraacetic acid) 4Na.4H2O 5.0 parts acetylenolEH (Kawaken Fine Chemicals Co., Ltd.) 0.1 part ion exchanger 69.9 parts

THIRD EXAMPLE

The printing operation was performed under the same conditions as in the first example, except that a different anti-coagulation liquid was used.

(Anti-Coagulation Liquid P3)

A mixture of the following elements was dissolved, and was filtered under pressure using a membrane filter (product name: Fluoropore filter, by Sumitomo Electric Industries, Ltd.) having a pore size of 0.22 μm, to obtain the anti-coagulation liquid P3.

<Composition of Anti-Coagulation Liquid P3> diethylene glycol 20.0 parts methyl alcohol 5.0 parts sodium hydroxide 0.5 part acetylenolEH (Kawaken Fine Chemicals Co., Ltd.) 0.1 part ion exchanger 74.4 parts Table 4 below shows the comparison results for the printing quality obtained by this embodiment and the conventional example. In Table 4, ○ denotes that, through visual observation, it was determined there was no problem with the printing quality. Δ denotes that the printing quality was slightly poorer, but was satisfactory for practical use. x denotes a printing quality that was lower than the previous two.

TABLE 4

| | | image quality | | | |
|---|---|---|---|---|---|
| | printing count (sheets) | conventional example | anti-coagulation liquid 1 | anti-coagulation liquid 2 | anti-coagulation liquid 3 |
| 100% duty printing | 1 | ○ | ○ | ○ | ○ |
| | 5 | Δ | ○ | ○ | ○ |
| | 10 | X | ○ | ○ | ○ |
| | 15 | X | ○ | ○ | ○ |
| | 20 | X | ○ | ○ | ○ |
| | 25 | X | ○ | ○ | ○ |
| | 30 | X | ○ | ○ | ○ |

According to the above described embodiment, the steps or the grooves are formed in the face surface at an appropriate distance from the discharge ports. Therefore, when, as one feature of the invention, the anti-coagulation liquid is applied before a discharge operation, the anti-coagulation liquid is drawn into the steps or the grooves, and a discharge operation is not performed while the anti-coagulation liquid is adhered to the discharge ports. As a result, for example, a deviation in the discharge direction can be prevented.

The head of this embodiment may be employed only as an ink discharge head or a reaction liquid discharge head, or as both heads. Naturally, it is most effective for the invention to be employed for both heads in order to reduce the deviation in the discharge direction. However, the deviation in the discharge direction can be reduced even when the present invention is applied for only one head. Therefore, this embodiment includes a mode wherein the present invention is applied for either or both of the ink discharge heads and the reaction liquid discharge head.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-069170 filed Mar. 11, 2004, which is hereby incorporated by reference herein.

What is claimed is:

1. An ink jet printing apparatus that, to perform printing, discharges ink and a reaction liquid onto a printing medium by employing an ink discharge port, for ejecting the ink, and a reaction liquid discharge port, for ejecting the reaction liquid that renders the ink insoluble or flocculated, comprising:

an application unit for, before the ink is discharged from the ink discharge port and/or the reaction liquid is discharged from the reaction liquid discharge port, applying a predetermined liquid to a discharge port face where the ink discharge port and/or the reaction liquid discharge port are arranged, in order to prevent or suppress the generation of an insoluble product or a flocculated product due to the reaction of the ink with the reaction liquid, wherein during discharge of at least one of the ink and the reaction liquid, the predetermined liquid applied by said application unit remains on the discharge port face.

2. An ink jet printing apparatus according to claim 1, wherein the predetermined liquid contains at least one of a surfactant, formaldehyde, 2-pyrrolidone, hexylene glycol, EG monoethyl ether, triethanolamine, 1,2,6-hexanetriol, sodium hydroxide, lithium hydroxide and magnesium hydroxide.

3. An ink jet printing apparatus according to claim 1, further comprising a wiping unit for wiping the discharge port faces after the ink has been ejected and/or the reaction liquid has ben ejected.

4. An ink jet printing apparatus according to claim 3, which enables the performance of a first printing mode in which the ejection of the reaction liquid from the reaction liquid discharge port is not performed, and only the ejection of the ink from the ink discharge port is performed, and a second printing mode in which both ejection of the reaction liquid from the reaction liquid discharge port and the ejection of the ink from the ink discharge port are performed, wherein the wiping unit wipes the discharge port faces the same number of times both in the first printing mode and the second printing mode.

5. An ink jet printing apparatus according to claim 1, wherein the application unit has a spray for spraying the predetermined liquid onto the discharge port faces.

6. An ink jet printing apparatus according to claim 1, wherein the application unit includes a holding member, for holding the predetermined liquid by using capillary attraction, and a rubbing unit for rubbing the holding member against the discharge port faces.

7. An ink jet printing apparatus according to claim 6, wherein the holding member is a rod-shaped member or a roller-shaped member.

8. An ink jet printing apparatus according to claim 1, wherein a peripheral area of the discharge ports in the discharge port faces is more liquid repellent than other areas.

9. An ink jet printing apparatus according to claim 1, wherein steps and/or grooves are formed in the discharge port faces.

10. An ink printing apparatus that, to perform printing, discharges ink and a reaction liquid onto a printing medium by employing an ink discharge port, for ejecting the ink, and a reaction liquid discharge port, for ejecting the reaction liquid that reacts with the ink, comprising:

an application unit for, before a printing operation is started, applying a predetermined liquid to a discharge port face where the ink discharge port is arranged and a discharge port face where the reaction liquid discharge port is arranged, in order to prevent or suppress a reaction product from being generated due to a reaction of the ink with the reaction liquid;

a printing control unit for performing the printing operation while the predetermined liquid is adhered to the discharge port faces;

a wiping unit for wiping the discharge port faces after the printing of a predetermined amount of data or when a predetermined period of time has been completed, wherein the application unit applies the predetermined liquid to the discharge port faces by bringing into contact with the discharge port faces a holding member that holds the predetermined liquid.

* * * * *

UNITED STATES PATENT AND TRADEMARK OFFICE

CERTIFICATE OF CORRECTION

PATENT NO. : 7,314,267 B2
APPLICATION NO. : 11/073732
DATED : January 1, 2008
INVENTOR(S) : Yamaguchi et al.

It is certified that error appears in the above-identified patent and that said Letters Patent is hereby corrected as shown below:

COLUMN 19:
Line 54, “ben” should read --been--.

COLUMN 20:
Line 44, “faces;” should read --faces; and--.

Signed and Sealed this

Third Day of March, 2009

JOHN DOLL
*Acting Director of the United States Patent and Trademark Office*